US008622504B2

(12) United States Patent
Uchida

(10) Patent No.: US 8,622,504 B2
(45) **Date of Patent: *Jan. 7, 2014**

(54) INK JET PRINTER AND A METHOD OF COMPUTING CONVEYANCE AMOUNT OF A CONVEYANCE ROLLER OF THE INK JET PRINTER

(75) Inventor: Naoki Uchida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/242,500

(22) Filed: Sep. 23, 2011

(65) Prior Publication Data

US 2012/0007917 A1 Jan. 12, 2012

Related U.S. Application Data

(63) Continuation of application No. 12/028,629, filed on Feb. 8, 2008, now Pat. No. 8,075,083, which is a continuation of application No. 11/365,039, filed on Mar. 1, 2006, now Pat. No. 7,354,129.

(30) Foreign Application Priority Data

Mar. 4, 2005 (JP) ..... 2005-060648
Feb. 17, 2006 (JP) ..... 2006-040961

(51) Int. Cl.
*B41J 29/38* (2006.01)

(52) U.S. Cl.
USPC ..... 347/16; 347/19

(58) Field of Classification Search
USPC ..... 347/16, 19
See application file for complete search history.

(56) References Cited

U.S. PATENT DOCUMENTS 6,076,915 A * 6/2000 Gast et al. ..... 347/19
6,126,345 A * 10/2000 Ito et al. ..... 400/624
8,075,083 B2 * 12/2011 Uchida ..... 347/19
2004/0066426 A1 * 4/2004 Yamada ..... 347/19

* cited by examiner

*Primary Examiner* — Matthew Luu
*Assistant Examiner* — Justin Seo
(74) *Attorney, Agent, or Firm* — Canon USA Inc. IP Division

(57) ABSTRACT

A method of computing a conveyance variance from a difference of two adjustment patterns in order to measure a variance in a conveyance amount occurring while a sheet is conveyed. By using this method, the variance that occurs during one rotation of the roller occurring because of the roller accuracy, deflection of the roller, and the attachment of a roller supporting member can be alleviated. Thus, the unevenness occurring synchronously to one rotation of the roller can be alleviated, and as a result, an ink jet printer that is capable of printing with high quality can be provided.

5 Claims, 17 Drawing Sheets

WHEN THE AREA FACTOR IS 100 %

WHEN THE AREA FACTOR IS NOT 100 %

WHEN THE ROLLER SHAPE IS A PERFECT CIRCLE

WHEN THE ROLLER IS SHAPED IN A DIFFERENT SHAPE

LF ROLLER ATTACHING MEMBER

INK JET PRINTER AND A METHOD OF COMPUTING CONVEYANCE AMOUNT OF A CONVEYANCE ROLLER OF THE INK JET PRINTER

CROSS-REFERENCE TO RELATED APPLICATIONS

This is a continuation of U.S. patent application Ser. No. 12/028,629 filed Feb. 8, 2008, and U.S. patent application Ser. No. 11/365,039 filed Mar. 1, 2006 and issued as U.S. Pat. No. 7,354,129, which claims priority from Japanese Patent Applications No. 2005-060648 filed Mar. 4, 2005 and No. 2006-040961 filed Feb. 17, 2006, all of which are hereby incorporated by reference herein in their entirety.

BACKGROUND OF THE INVENTION

1. Field of the Invention

The present invention relates to an ink jet printer, and more specifically relates to control of a conveyance roller that conveys a paper sheet.

2. Description of the Related Art

Recently, due to widespread use of personal computers and digital still cameras, printing apparatuses that utilize various methods have been developed in order to print out information produced and processed by such apparatuses. In addition, in the printing apparatuses, technology for higher recording and technology for higher print quality have been rapidly developed. In this regard, among the various types of printing apparatuses, an ink jet type serial printer that utilizes a dot matrix recording (printing) method has attracted much attention as a recording apparatus (printing apparatus) that implements printing with a higher speed and with a higher quality, and with lower costs of manufacture, as well. On the other hand, for a method of recording at a high speed in the ink jet type printing apparatus, there is a bi-directional printing method. In addition, for a method of recording with high quality in the ink jet type printing apparatus, there is a multi-pass printing method, for example.

In the ink jet printing apparatus, in order to obtain a high-quality image, it is absolutely necessary that each of a plurality of ink droplets for forming an image is jetted to be dotted at a correct position on a print medium (referred to also as a paper sheet or a recording medium) and that dots are printed in a relatively correct and accurate arrangement. However, the placement of the dots gets inaccurate due to various kinds of variance included in the printing apparatus. Further, in carrying out the bi-directional printing and the multi-pass printing, the placement of the dots gets inaccurate due to variance caused due to performance of different scanning operations for recording. Therefore, in recent printing apparatuses, a processing for aligning recording positions for aligning the placement accuracy of the dots has been a necessary technology. The recording position aligning processing is a method for aligning the positions at which the dots are formed onto the printing medium by some method. For the recording position aligning processing, there is a technology such that a correction in a main scanning direction is performed so that the dot placement position by recording scanning in a forward direction and the dot placement position by recording scanning in a return direction are matched with each other. Further, there is a method such that a correction in a sub scanning direction (that is, correction of an amount of conveyance of the print medium) is performed so that the dot placement position by a preceding recording scanning and the dot placement position by a subsequent recording scanning carried out after the print medium is conveyed are matched with each other.

A correction method in the sub scanning direction in a conventional ink jet printer is described, for example, in Japanese Patent Application Laid-Open No. 2003-011344 (corresponding to U.S. Pat. No. 6,769,759). Japanese Patent Application Laid-Open No. 2003-011344 discloses a technology such that a plurality of test patterns produced by differing the amounts of conveyance of the recording medium carried out during two pass of recording scanning are printed, then an optimum pattern is selected based on a result of printing of the test patterns, and thus a correction value of the conveyance amount is determined based on the selected test pattern. Further, Japanese Patent Application Laid-Open No. 2003-011344 discloses conveyance of paper sheet by a conveyance amount in accordance with a thus-determined correction value is carried out in performing printing.

Recently, demand for a high-quality image that is outputted from a recording apparatus with a quality as high as the quality of a photograph has been growing. Accordingly, an accuracy of conveyance of the recording medium by a conveyance roller has been improved. As the conveyance accuracy improves, it is more and more necessary that the positional alignment of the dots in the sub scanning direction be at a higher accuracy. However, in order to carry out the alignment processing in the sub scanning direction with a high accuracy, it is necessary to overcome the following drawback.

That is, as the accuracy of conveyance of the recording medium improves, an amount of slide occurring in conveying the recording medium is more accurately corrected than before. Therefore, an affect from a variance in the conveyance amount, with one rotation of the roller being a period, that occurs due to variance of an outer shape of the roller, deflection of the roller, and an attachment of a roller supporting member has been relatively high.

Here, an explanation is made as to a relationship between the affect from the variance in the conveyance amount and the image.

In this regard, the conveyance of the paper sheet is implemented by the rotation of the conveyance roller (hereinafter simply referred to also as a "roller"). For example, if a circumference of the roller is 47 mm, and when the paper sheet is conveyed by one rotation of the roller, then the paper sheet is conveyed by 47 mm.

In this regard also, when multi-pass printing for implementing high-quality printing is used, the conveyance amount in one operation of the multi-pass printing is less than a length corresponding to one rotation of the roller (47 mm). For example, the conveyance amount of the paper sheet in performing the high-quality printing is about 3.4 mm. That is, about fourteen times of sheet conveyance are carried out until the conveyance roller of the circumferential length of 47 mm fully rotates.

In this case, a variance in the conveyance amount per each phase angle, with a period being one rotation of the roller, that occurs due to the variance in the outer shape of the roller, deflection of the roller, and the attachment of a roller supporting member affects the sheet conveyance.

FIG. 6A and FIG. 6B are schematic diagrams showing a difference of sheet conveyance amount depending on the shape of the roller. If the shape of the roller is a perfect circle, and suppose that an angle of rotation of the roller for sheet conveyance is even, the conveyance amount when the roller is rotated by an angle R is the same at every position. However, when the roller has a shape different than a perfect circle, the conveyance amount when the roller is rotated by the same angle R differs depending on the rotational position of the roller. For example, if the shape of the roller is oval as shown in FIG. 6B, the sheet is conveyed in an amount L1 at a certain rotational position. Further, at another rotational position, the sheet is conveyed by an amount L2. In this case, the relationship between the length is L1>L0>L2, and thus the variance in the sheet conveyance dependent on the period of the roller occurs.

If there occurs such variance in the sheet conveyance amount dependent on the roller period, there occurs unevenness in the image recorded by the recording apparatus, and thus the quality of recording is degraded. The occurrence of the sheet conveyance amount dependent on the roller period brings about unevenness in the dot placement position of droplets, depending on the rotational position of the roller. FIG. 7A and FIG. 7B are schematic diagrams showing the unevenness. A left portion of FIG. 7A shows a roller position, and a right portion of FIG. 7A shows a direction in which the dot placement positions are deviated dependent on the roller position. In addition, FIG. 7B is a schematic diagram of a state in which the image is recorded in a state where the dot placement position is deviated. As shown in FIG. 7A, when the roller is positioned at the position L1, the sheet conveyance amount is larger than the amount of conveyance in an ordinary case, and, therefore, the image to be printed is printed in a portion lower than a position at which the actual printing is desired (an ideal position). In addition, if the roller is positioned at the position L2, the sheet conveyance amount is smaller than the conveyance amount in an ordinary case, and accordingly, the image to be printed is printed in a portion that is higher than the ideal position. Therefore, when an even image is printed, there occurs a difference in density (unevenness), as shown in FIG. 7B. The unevenness occurs much with respect to an even image such as a background portion of a scenery image, and brings a negative effect against high-quality printing.

Of course, machine accuracy of the recording apparatus has been improved in order to enable high-quality image recording. However, it is technically difficult to improve the machine accuracy to a level at which no such defect arises, and is not preferable considering a cost performance.

As described above, the variance in the outer shape of the roller causes the variance in the conveyance amount with a period of one rotation of the roller. In the same way, the deflection of the roller and the attachment of a roller supporting member brings about the variance in the conveyance amount with a period of one rotation of the roller.

Further, in the method for aligning the recording position in the sub scanning direction in which a plurality of test patterns are printed by differing the amounts of conveyance of the recording medium carried out during two passes of recording scanning, the amount of conveyance of the recording medium carried out during the recording scanning includes a variance in the conveyance due to eccentricity of the conveyance roller, in addition to the predetermined conveyance amount. In the conventional recording position aligning method, a plurality of test patterns is printed by arranging the test patterns in the sub scanning direction, and accordingly, a conveyance variance component due to the eccentricity of the conveyance roller in printing the test patterns differs in each test pattern. That is, in a method such that one of the test patterns printed in the plurality in the sub scanning direction is selected and the correction of the conveyance amount is carried out in accordance with the test pattern, the conveyance amount to be corrected includes a conveyance variance component due to the eccentricity of the conveyance roller at a predetermined position. Therefore, even if the recording position is aligned in the sub scanning direction, the recording position may not be accurately aligned in the case of conveyance in which the predetermined position of the conveyance roller is not used, thus hindering high-quality printing.

SUMMARY OF THE INVENTION

The present invention is directed to a recording apparatus and a method of computing a variance in a conveyance amount occurring within one rotation of a roller at the time of conveyance of a sheet.

The method of computing the variance in the conveyance amount is such that the variance in the conveyance amount is computed based on a difference in the density of each of two adjustment patterns in order to align the variance in the conveyance amount occurring at each roller position at the time the conveyance roller is rotated little by little.

Further, the method for computing the variance in the conveyance amount is such that the factors of occurrence of the variance in the conveyance amount are determined, the factors are modeled, and then the variance in the conveyance amount to be computed is computed by approximation of functions.

In one aspect of the present invention, a recording apparatus including a main scanning unit configured to reciprocatingly move a recording head on which a plurality of nozzles that discharge ink is disposed in a main scanning direction and a sub scanning unit configured to convey a recording medium in a sub scanning direction that is different from the main scanning direction via a conveyance roller, the recording apparatus performing recording onto the recording medium via the recording head, includes a first recording unit configured to record a plurality of first patterns in the main scanning direction onto the recording medium; a second recording unit configured to record a plurality of second patterns in the main scanning direction onto the recording medium after the recording medium is conveyed by the sub scanning unit, which uses one of nozzles corresponding to an area in which the first pattern is recorded and nozzles disposed in a vicinity thereof, and wherein the nozzles used for each of the plurality of second patterns are different from each other; and a computation unit configured to compute a conveyance amount of the recording medium conveyed by the sub scanning unit based on a difference in a density of the plural patterns that are formed by the first pattern and the second pattern.

In another aspect of the present invention, a recording apparatus including a main scanning unit configured to reciprocatingly move a recording head on which a plurality of nozzles that discharge ink is disposed in a main scanning direction and a sub scanning unit configured to convey a recording medium in a sub scanning direction that is different from the main scanning direction via a conveyance roller, and performing recording onto the recording medium via the recording head, includes a first recording unit configured to record 2M number of first patterns in the main scanning direction onto the recording medium, wherein M is an integer of or greater than 2; a second recording unit configured to record M number of second patterns in the main scanning direction onto the recording medium after the recording medium is conveyed by the sub scanning unit in specific number of times, wherein the second recording unit uses one of nozzles corresponding to an area in which the first pattern is recorded and nozzles disposed in a vicinity thereof, and wherein the nozzles used for each of the plurality of second patterns are different from each other; and a recording control unit configured to record, after the first pattern is recorded by the first recording unit, M number of second patterns via the second recording unit when (N−1) times of operations for conveying the recording medium is carried out, wherein N is an integer of or greater than 2, and to record M number of the second patterns via the second recording unit in a case where the conveyance operation of the recording medium is performed N times.

In another aspect of the present invention, a method of computing a conveyance amount of a conveyance roller in a recording apparatus including a main scanning unit configured to reciprocatingly move a recording head on which a plurality of nozzles that discharge ink is disposed in a main scanning direction and a sub scanning unit configured to convey a recording medium in a sub scanning direction that is different from the main scanning direction by using the conveyance roller, the recording apparatus performing recording onto the recording medium by using the recording head, the method including a first recording step of recording a plurality of first patterns onto the recording medium in the main scanning direction; a second recording step of recording a plurality of second patterns in the main scanning direction after the recording medium is conveyed by the sub scanning unit, using nozzles corresponding to an area of the recording medium onto which the first pattern is recorded or nozzles in a vicinity thereto, the nozzles or a combination of nozzles that are used for each of the plurality of second patterns being different from one another; and a computation step of computing a conveyance amount of the recording medium that is conveyed by the sub scanning unit based on a difference in a density of plural patterns formed by the first pattern and the second pattern.

In another aspect of the present invention, a method of computing a conveyance amount of a conveyance roller in a recording apparatus including a main scanning unit configured to reciprocatingly move a recording head on which a plurality of nozzles that discharge ink is disposed in a main scanning direction and a sub scanning unit configured to convey a recording medium in a sub scanning direction that is different from the main scanning direction by using the conveyance roller, the recording apparatus performing recording onto the recording medium by using the recording head, the method including a first recording step of recording 2M number of first patterns in the main scanning direction onto the recording medium, wherein M is an integer of or greater than 2; a second recording step of recording M number of second patterns in the main scanning direction onto the recording medium after the recording medium is conveyed by the sub scanning unit in specific number of times, using nozzles corresponding to an area in which the first pattern is recorded or using nozzles disposed in a vicinity thereof, wherein the nozzles or the combination of nozzles used for each of the plurality of second patterns are different from each other; and a recording control step of recording, after the first pattern is recorded by the first recording unit, M number of second patterns by using the second recording unit when (N−1) times of operations for conveying the recording medium is carried out, wherein N is an integer of or greater than 2, and recording M number of the second patterns by using the second recording unit in a case where the conveyance operation of the recording medium is performed N times.

According to the present invention, the variance in the conveyance amount at each roller position in rotating the conveyance roller little by little is computed, and the variance is corrected to carry out the operation of conveying the recording medium, and thus the recording apparatus that is capable of performing a high-quality printing. In addition, according to the present invention, in order to compute the variance in the conveyance amount, the variance in the conveyance amount is computed based on the difference in the density of two adjustment patterns. Computation of the variance in the conveyance amount enables reduction of the variance occurring during one rotation of the conveyance roller brought about due to the variance in the accuracy of the conveyance roller, the deflection of the conveyance roller, and the attachment of the conveyance roller supporting member. Thus, the unevenness synchronous to the period of the conveyance roller can be suppressed.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Exemplary embodiments of the present invention will now be described in detail with reference to the drawings. It should be noted that the relative arrangement of the components, the numerical expressions, and numerical values set forth in these embodiments do not limit the scope of the present invention unless it is specifically stated otherwise.

The present invention can be implemented in an ink jet recording apparatus that carries out recording onto a recording medium while reciprocatingly moving a carriage installed with a recording head in a main scanning direction and also conveys the recording medium in a sub scanning direction after recording scanning is completed.

In the present embodiment, in order to control a variance in an amount of conveyance occurring at each roller position when a conveyance roller is rotated little by little, the variance in the conveyance amount is computed based on a difference between the conveyance amounts of two adjustment patterns (referred to also as a test pattern or a patch). In this regard, a technology of a processing for recording position aligning processing in the sub scanning direction is applied such that a reference pattern is recorded, a paper sheet is conveyed, patterns are recorded in an overlapped manner, and an area factor is evaluated after the patch is recorded.

Therefore, for an easier understanding of the exemplary embodiment according to the present invention, first, an explanation of the recording position aligning processing in the sub scanning direction is provided.

Figure 2:
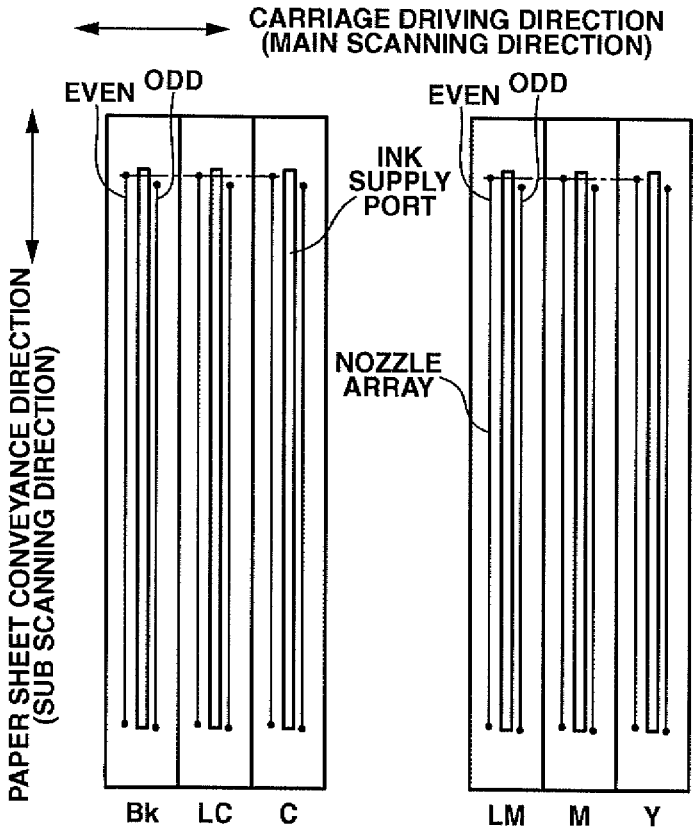
FIG. 2 is a schematic diagram of a print head that is used in the present invention.

FIG. 2 shows a print head used in the exemplary embodiment. As shown in FIG. 2, the print head is provided with twelve nozzle array groups (six colors×two arrays) in a driving direction of a carriage (that is, the main scanning direction). Here, the nozzle array groups are arranged with a resolution of 600 dpi. Each nozzle array has 1,280 nozzles. The six-color nozzle arrays respectively have EVEN arrays and ODD arrays, and the EVEN array and the ODD array are arranged apart from each other by 1,200 dpi in a direction of sheet conveyance (sub scanning direction). The arrangement of the EVEN arrays and the ODD arrays shifted from one another in a direction of sheet conveyance enables a printing resolution in the sheet conveyance direction as high as 1,200 dpi.

Hereinbelow, an explanation of a case where the patch is printed by using a Bk (black) nozzle is provided. However, the color to be used is not limited with respect to the printing of the patch.

Figure 3A:
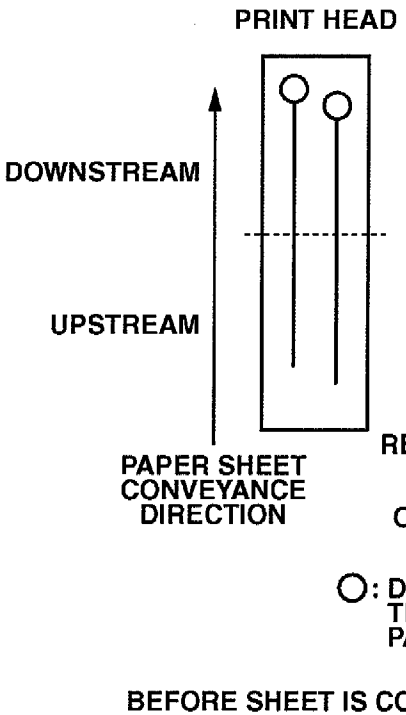
FIGS. 3A and 3B are diagrams that respectively explain the procedure for recording an adjustment pattern.

In this regard, two arrays of Bk nozzles are divided into two in relation to the sheet conveyance direction. First, a reference pattern is printed by using an upstream nozzle, in the sheet conveyance direction (FIG. 3A). Next, the recording medium is recorded by the conveyance amount in a length equivalent to half the length of the nozzle array. A conveyance resolution is a numerical value dependent on a performance of the printer, and in this case, it is assumed that the sheet conveyance can be performed with a resolution of 9,600 dpi. A command pulse value used to convey the sheet by an amount equivalent to a half of the nozzles (a number of nozzles equivalent to a half of the nozzle array×resolution of the nozzle array/resolution of the conveyance amount) under these conditions is as described below.

$$640\times25.4/1{,}200/25.4\times9{,}600=5{,}120$$

where the number of nozzles equivalent to a half of the nozzle array is 640, the resolution of the nozzle array (distance between the nozzles) is 1,200 dpi, and the resolution of the conveyance amount is 9,600 dpi. In addition, a theoretical value of the conveyance amount of the recording medium conveyed in accordance with the command pulse value (5,120) is computed as follows:

$$640\times25.4/1200=13.55\ [\text{mm}].$$

Figure 3B:
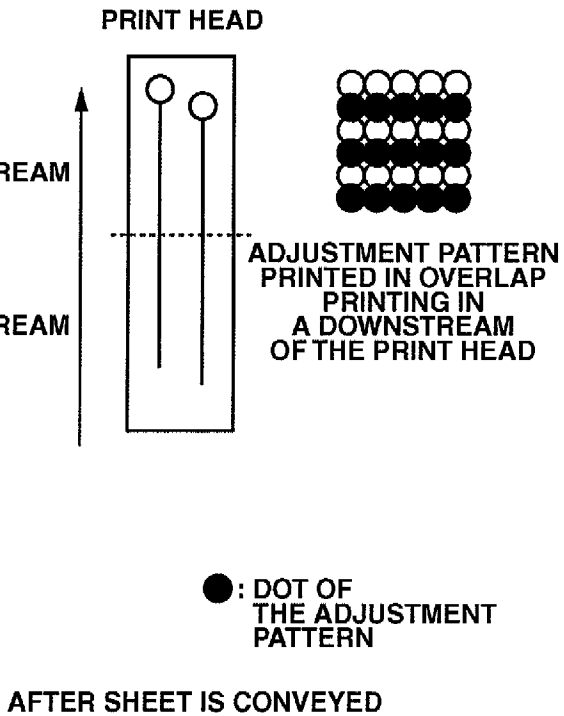

After the recording medium is conveyed in a length equivalent to the theoretical value of the conveyance amount of the recording medium, the adjustment pattern is recorded by using the nozzles disposed downstream of the recording head. In this case, the adjustment pattern is printed in a manner overlapping the reference pattern that was previously recorded. FIG. 3B shows a schematic diagram of the pattern printed in the overlapped manner. The dots represented in a reverse type are the dots formed onto the recording medium by using the upstream nozzles, and the dots represented in black indicate the dots formed onto the recording medium by using the downstream nozzles. In this way, the reference pattern (a first pattern) and the adjustment pattern (a second pattern) are recorded by mutually different recording scanning, and thus one single patch (test pattern) is formed.

In FIGS. 3A and 3B, white dots and black dots are used for explanation. However in this embodiment, each dot is a dot formed with ink jetted from the same print head. That is, the white dots and the black dots do not represent the actual color and density of dots used in printing.

Figure 4A:
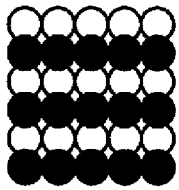
FIGS. 4A and 4B are schematic diagrams of adjustment patterns that are recorded by overlapping the patterns.

When the recording medium is conveyed in the same amount as the theoretical value [13.55 mm] of the conveyance amount of the recording medium by issuing the command pulse value, an area factor of the pattern formed by the reference pattern and the adjustment pattern is about 100%. As shown in FIG. 4A, when the area factor is about 100%, the overlapping of dots formed by the recording scanning for recording the reference pattern or the adjustment pattern occurs in a minimum amount, and thus the whole surface is filled with dots.

Figure 4B:
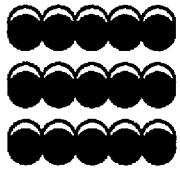

However, there is a case where an actual conveyance amount differs from the theoretical value even if the command pulse value is issued, because of mechanical accuracy of the recording apparatus and variance in the medium occurring due to an environment (temperature, humidity, and the like) or the like. The pattern printed in such case is as shown in FIG. 4B, and the area factor does not reach 100%. When the area factor is below 100% (50% at a minimum), the dots formed by the recording scanning for recording the reference pattern or the adjustment pattern are mutually overlapped, and thus a ratio of formed dots in relation to a surface area of the sheet is small.

The patch is intended to make the area factor to be about 100% when the sheet is conveyed in a desired amount. Assuming that the patch recorded at a command pulse value of 5,120 is as shown in FIG. 4B and that the patch recorded at a command pulse value of 5,120 is as shown in FIG. 4A, the command pulse value in conveying the sheet in an amount equivalent to the theoretical value of the conveyance amount of the recording medium onto which the patch is recorded can be obtained. When the command pulse value is 5,122, the area factor of the patch is about 100%, and then the command pulse value in conveying the sheet in an amount equivalent to the theoretical value of the conveyance amount [13.55 mm] may be 5,122.

That is, a correct command pulse value is obtained by detecting the area factor of the patch formed as a result of changes the command pulse value for conveying the sheet after the reference pattern is recorded. In this regard, the difference between the correct command pulse value (here, 5,122) and the theoretical command pulse value (here, 5,120) (here, the difference is, accordingly, +2) is equivalent to the deviation of the conveyance position.

In order to compute the deviation of conveyance position, a following method has conventionally been used.

Figure 5:
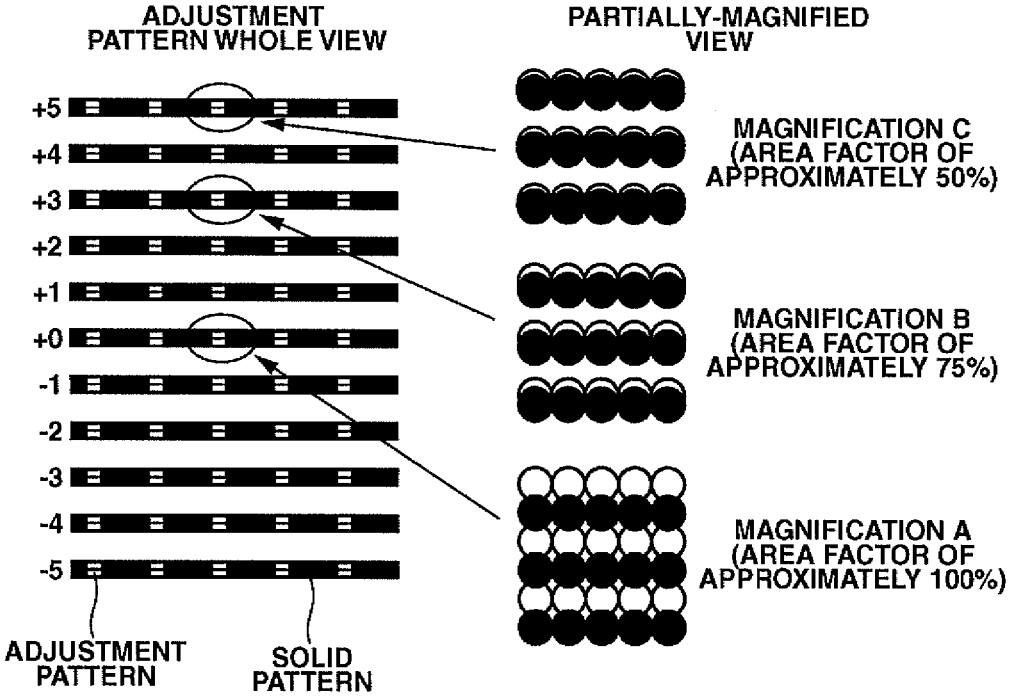
FIG. 5 is a diagram of a whole part of the adjustment pattern, with some portions magnified.
Figure 6A:
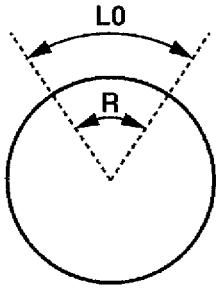
FIGS. 6A and 6B are schematic diagrams showing a difference in an amount of sheet conveyance dependent on a shape of a roller.
Figure 6B:
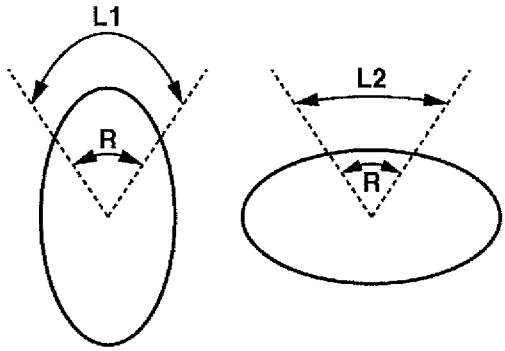
Figure 7A:
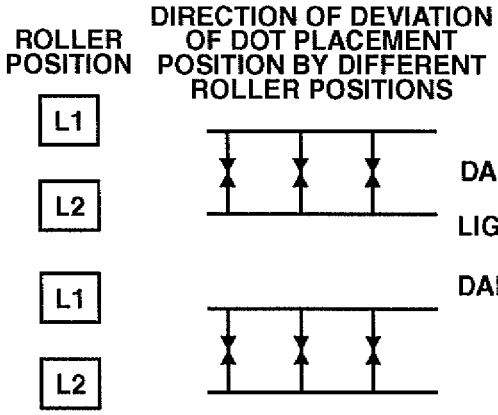
FIGS. 7A and 7B are schematic diagrams respectively showing unevenness that occurs with respect to the shape of the roller.
Figure 7B:
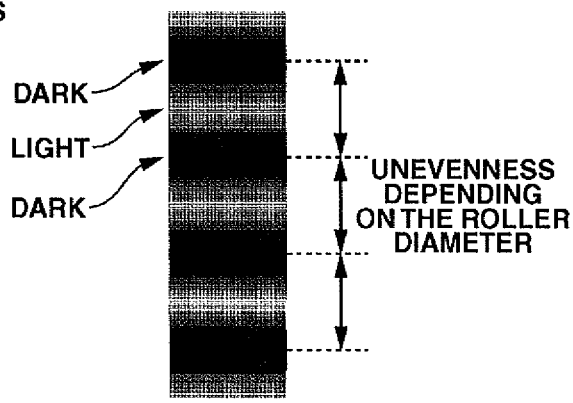

FIG. 5 shows a whole part of the patch, and one part of the patch is magnified. With respect to the patch that is shown in FIG. 5 as an example, different command pulse values are used, and eleven different kinds of patches are recorded with a range of adjustment of ±5.

Further, in order to readily select the patch by a visual check with the eyes of a user, five patches and five solid patterns are disposed in the main scanning direction.

For the patch of an adjustment value of +0, the adjustment pattern is printed by conveying the sheet in an amount equivalent to the command pulse value 5,120 after printing the reference pattern. In this case, the patch that is printed if there occurs no mechanical variance of the recording apparatus and no variance in the media occurring due to the environment is the pattern of the area factor of about 100% (a magnification A in FIG. 5), theoretically.

For the patch of an adjustment value of +3, the adjustment pattern is printed by conveying the sheet in an amount equivalent to the command pulse value 5,123 after printing the reference pattern. In this case, the patch that is printed is the pattern of the area factor of about 75% (a magnification B in FIG. 5), theoretically.

For the patch of an adjustment value of +5, the adjustment pattern is printed by conveying the sheet in an amount equivalent to the command pulse value 5,125 after printing of the reference pattern. In this case, the patch that is printed is the pattern of the area factor of about 50% (a magnification C in FIG. 5), theoretically.

Thus, with respect to the patches of the adjustment values ranging from +0 to +5, each pattern is recorded by changing the conveyance amount of the recording medium, ranging from 5,120 to 5,125. In the same way, with respect to the patches of the adjustment values ranging from −1 to −5, each pattern is recorded by changing the conveyance amount of the recording medium, ranging from 5,119 to 5,115, to print the patch.

Theoretically, the pattern of the area factor of about 100% is the pattern of the adjustment value of +0. However, there is a case where the theoretical value of the conveyance amount of the sheet conveyed in accordance with the command pulse value and the amount of actual conveyance of the recording medium differ from each other due to deformation of the recording medium due to the accuracy of the recording apparatus, the environment (temperature and humidity) and the like. If the theoretical value of the conveyance amount of the sheet conveyed in accordance with the command pulse value and the amount of actual conveyance of the recording medium differ from each other, the area factor is not about 100% when the adjustment value is +0, but the area factor is about 100% when the adjustment value is the other values. An optimum recording can be performed by selecting the pattern whose area factor is about 100% from among a plurality of patches recorded by changing the command pulse value, and the command pulse value when the selected pattern is recorded is defined as the command pulse value of conveyance of recording medium in the recording operation. Further, the command pulse value can be obtained in a case where it is desired to convey the recording medium by an arbitrary conveyance amount, based on the relationship between the command pulse value and the actual conveyance amount of the recording medium.

The method in which the variance of the conveyance amount that is the difference between the theoretical conveyance amount by which the sheet is conveyed in accordance with the command pulse value and the actual conveyance amount of the recording medium can be effectively performed. However, it is difficult to use the method as it is to determine the variance in the conveyance amount per phase angle of the conveyance roller, which is the purpose of the present invention.

That is, the rotational amount of the conveyance amount is too small and the variance in the conveyance amount is too small to quantify the variance in the conveyance amount by segmenting the conveyance roller per each phase angle. Therefore, if the above method is utilized, an S/N ratio is decreased, and as a result, the detection accuracy is lowered. If the S/N ratio is improved by repeatedly determining the variance in the conveyance amount and averaging the determined variances, to prevent this defect, then the amount of paper sheets and the amount of ink to be used for recording the patch increases too much.

The characteristic constitution and the method of the present invention for overcoming this defect are explained in detail below.

Figure 11:
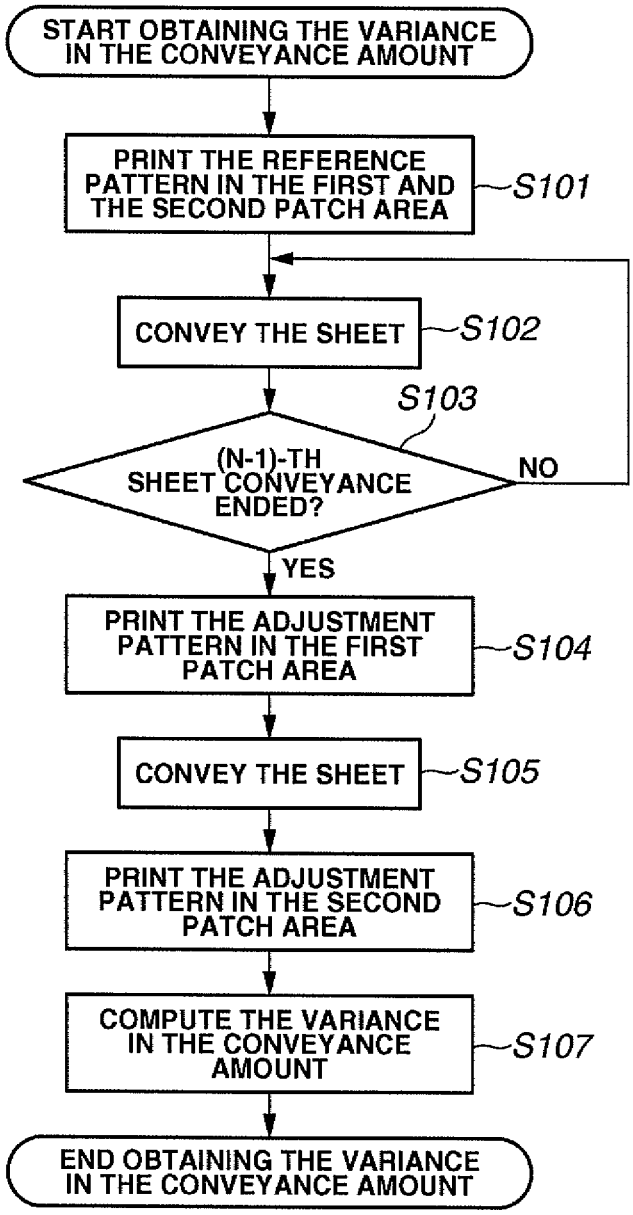
FIG. 11 is a flow chart for computing a variance in a conveyance amount by the conveyance roller at a very small phase angle.

First, a flow chart for obtaining the conveyance amount at a very small phase angle of the conveyance amount is shown in FIG. 11, and the explanation thereof is made below.

Figure 16A:
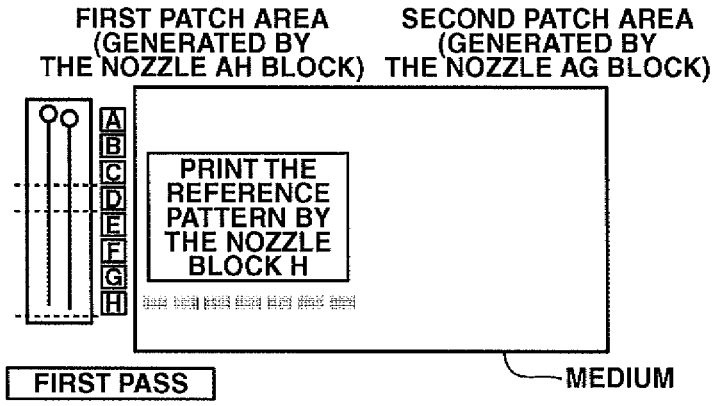
FIGS. 16A through 16D are diagrams that respectively show a printing method of the adjustment pattern (one line only) according to this embodiment.
Figure 16B:
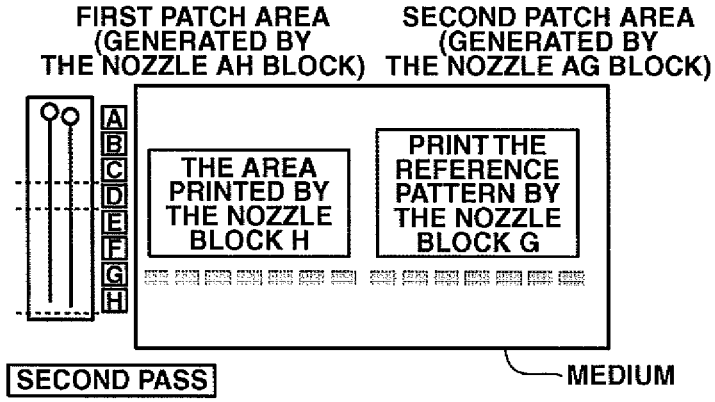
Figure 16C:
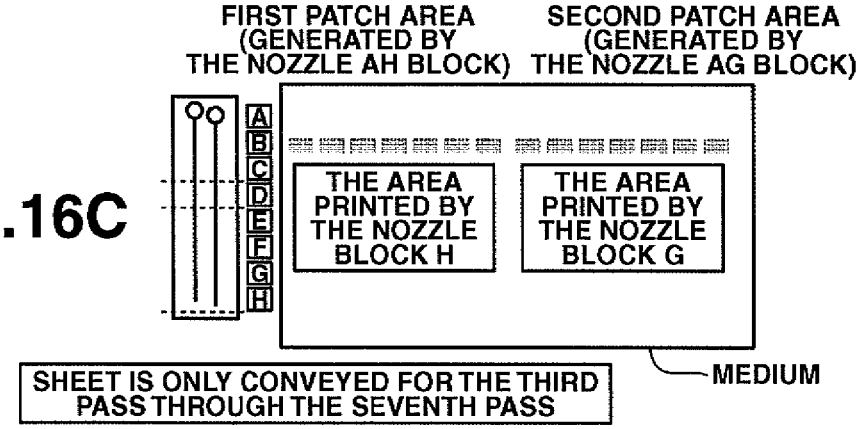
Figure 16D:
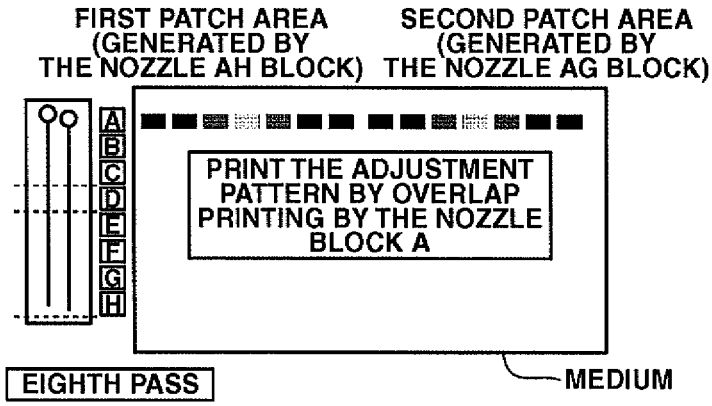
Figure 17A:
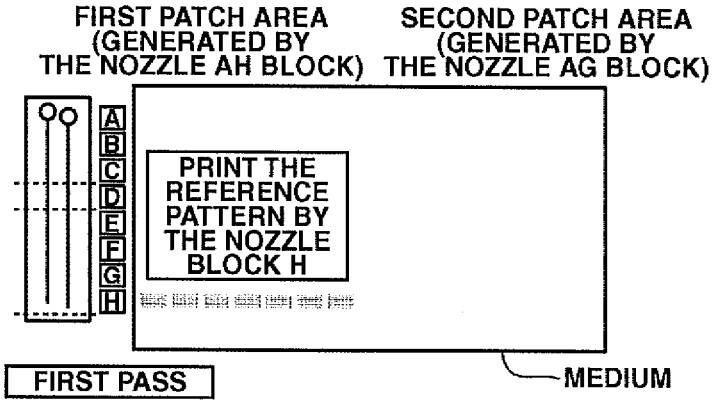
FIGS. 17A through 17D are diagrams that respectively show a printing method of the adjustment pattern (continuous printing) according to this embodiment.
Figure 17B:
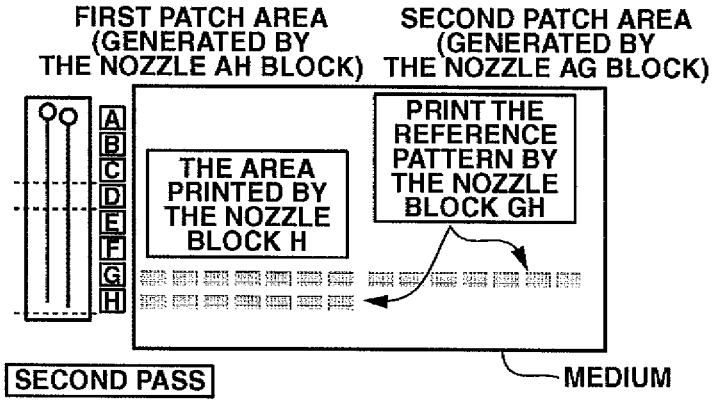
Figure 17C:
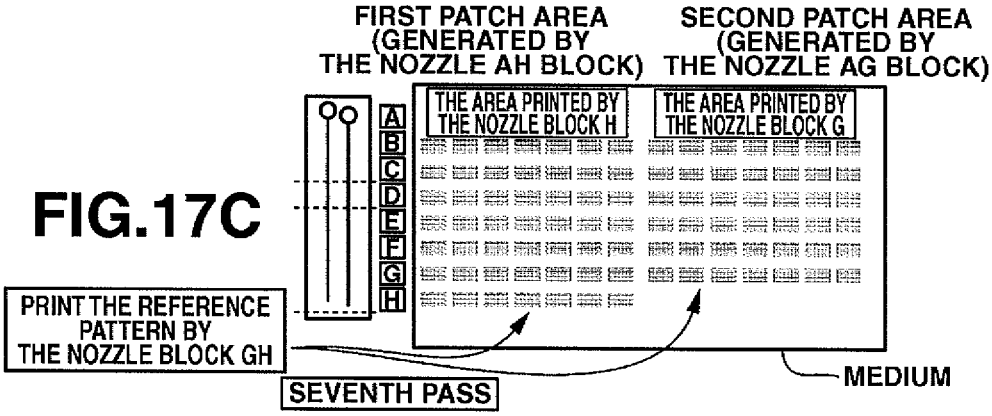
Figure 17D:
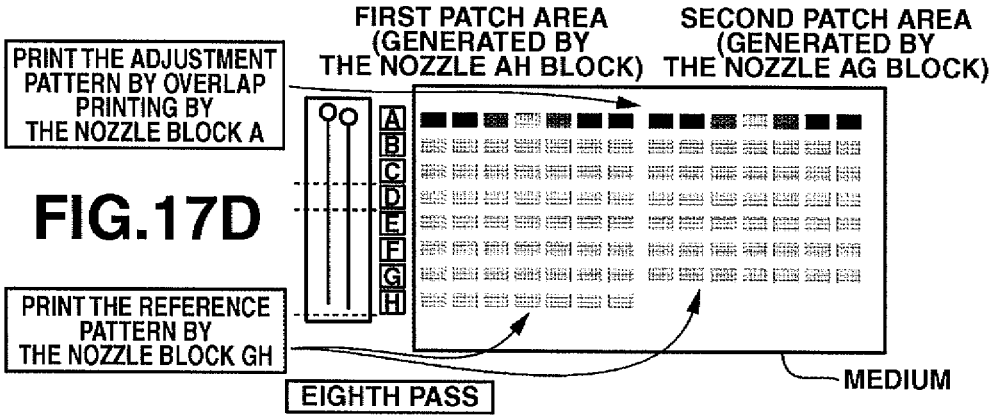

When the patch is recorded in accordance with the flow chart in FIG. 11, a result as shown in FIG. 16D is obtained. As can be recognize from FIG. 16D, the patch to be printed includes two significant groups. Hereinbelow, a first patch group, among the two groups of patches, which is shown in a left portion is referred to as a first patch, and an area in which the second patch is printed is referred to as a second patch area. These two patch areas are arranged in parallel in the main scanning direction.

In order to obtain the variance in the conveyance amount when the conveyance roller is rotated at a very small phase angle, first, the reference pattern is printed in the first and the second patch areas by using predetermined nozzles (step S101). In this case, a plurality of reference patterns is printed in each of the first and the second areas, and all the plural reference patterns are recorded by using the same nozzles.

Next, an (N−1) times of sheet conveyance operations are performed (steps S102 and S103). Then, the adjustment pattern is printed in the first patch area by using the nozzles different than the nozzles used in printing the reference pattern in step S101 (step S104). In this case, the reference pattern printed in step S101 and the adjustment pattern printed in step S104 are printed in an overlapped manner. Here, in step S104, a plurality of adjustment patterns is printed, and the plural adjustment patterns are printed by using mutually different nozzles (or by a combination of different nozzles). Thus, the plural patches printed in the first patch area are printed at printed positions relatively different from one another.

Next, one pass of sheet conveyance is carried out (step S105), and the adjustment patter is printed in the second patch area by using the nozzles different than the nozzles that are used in printing the reference pattern in step S101 (step S106). Here, in step S106, a plurality of the adjustment patterns is printed, and the plural patches are printed by using mutually different nozzles (or by a combination of different nozzles).

Next, an optical sensor installed to a carriage is caused to perform scanning, and thus the density of each of the plural patches printed in the first and second patch areas is measured, so that the variance in the conveyance amount when there is a slight difference in the phase angle of the conveyance roller is computed (step S107). Note that for measuring the patch density, an amount of reflective light upon irradiation of a light onto the patch is determined. In addition, in this regard, a plurality of operations for determining the reflective light amount by using the optical sensor may be performed. When a plurality of determination operations are performed, the affect from the variance can be decreased.

The principal in obtaining the variance in the conveyance amount at a slight difference in the phase angle of the conveyance roller is as follows. From among the plural patches respectively printed in the first and the second patch areas, a patch whose reference and adjustment patterns are printed in a most overlapped manner is selected by the optical sensor. Then, an accurate sheet conveyance amount of the selected patch is computed by a method to be described below. The conveyance amount of the reference pattern and the adjustment pattern that are printed in the first patch area is smaller than the conveyance amount of the reference pattern and the adjustment pattern that are printed in the second patch area, by a difference equivalent to one pass of conveyance. Therefore, the sheet conveyance amount in one pass can be obtained by computing the difference in the accurate sheet conveyance amount of the patch that is selected in each of the first and the second patch areas.

Figure 1:
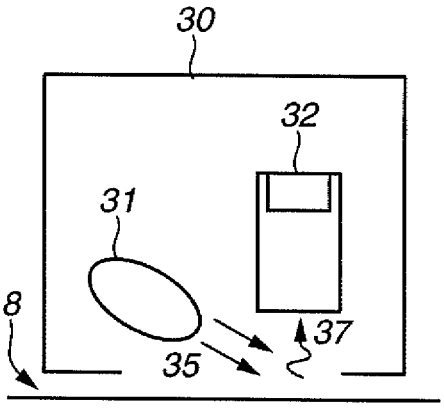
FIG. 1 is a schematic diagram that explains a reflection type optical sensor.

Next, the optical sensor that measures the density of the patch is explained. FIG. 1 is a schematic diagram that explains a reflection type optical sensor. FIG. 1 is a schematic diagram that explains a reflection type optical sensor 30.

The reflection type optical sensor 30 is provided with a light emission unit 31 and a light receiving unit 32. A light Iin 35 that is emitted from the light emission unit 31 is reflected on a surface of a recording medium 8. The light receiving unit 32 determines an amount of reflected light that is reflected on the surface of the recording medium 8. For the reflective light, there are a normally reflected light and a diffused and reflected light. In order to more accurately determine the density of the image formed on the recording medium 8, a diffused and reflected light Iref 37 is determined. Thus, the light receiving unit 32 is disposed differently from a light incidence angle. The patch density at an arbitrary position can be determined by the sheet conveyance and the scanning by the carriage installed with the reflection type optical sensor 30. A determined signal that is obtained by the determination is sent to an electronic substrate of the printer. Note that the reflection type optical sensor 30 may also be used as a detection unit that detects an edge portion of the sheet or a discrimination unit that discriminates a kind and a type of the sheet, as a double-purpose unit.

Here, in order to perform a resist adjustment of all the heads that discharge ink of each color of C, M, Y, K, a white LED or a three-colored LED is used for the light emission unit, and a photodiode that is sensitive to a visible light range is used for the light receiving unit. However, in determining the relationship between the relative recording position of the images recorded in an overlapped manner and the density, if adjustment is performed for different colors, the three-colored LED should be used, which can select a color of a more determination sensitivity.

Note that it is not necessary to determine an absolute value of the density in determining the density of the image formed onto the recording medium 8. In addition, the determination resolution at a level at which a relative difference of each patch among the plural patches printed in a predetermined area is described below.

Further, stability of a determination system that includes the reflection type optical sensor 30 may be at a level that does not affect the difference in the determined density until the determination for the printed plural patches is completed by one rotation of the conveyance roller. With respect to the sensitivity adjustment, calibration can be performed, for example, by moving the reflection type optical sensor 30 to a portion of the sheet in which no image is recorded. In one such adjustment method, a light emission intensity of the light emission unit 31 is adjusted so that a determination level comes to a threshold value. Alternatively, there is a method in which a gain of a determination amplifier within the light receiving unit 32 is adjusted. Note that the sensitivity adjustment is not essential. However, the sensitivity adjustment is suitable for a method of improving the S/N ratio and the determination accuracy.

Hereinbelow, a method of computing the sheet conveyance amount based on the reference pattern and the adjustment pattern is explained.

Figure 23:
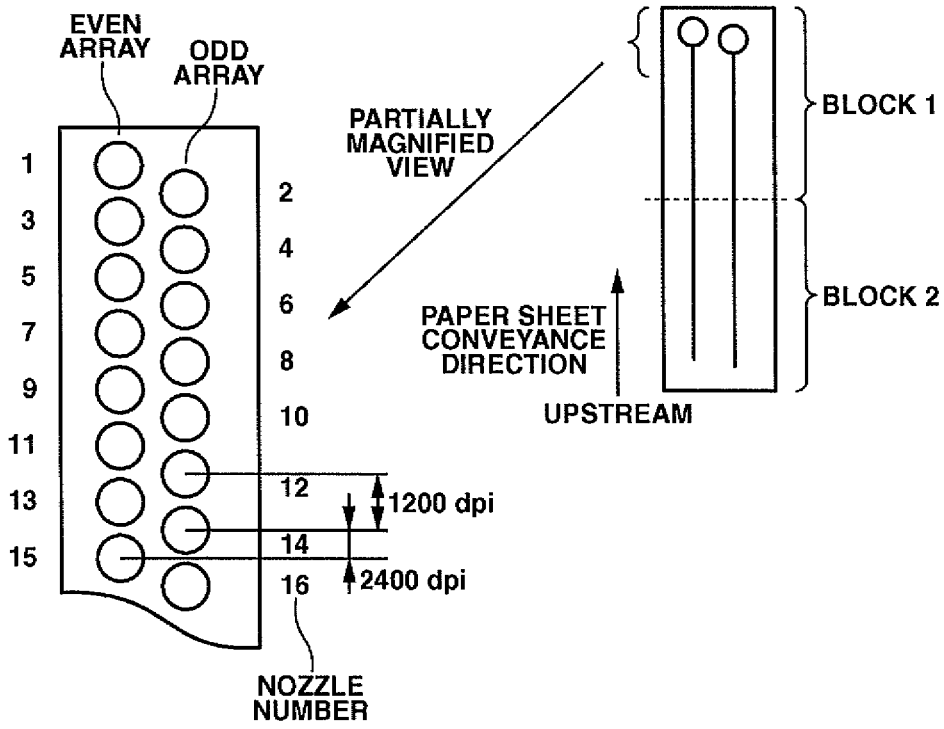
FIG. 23 is a diagram that shows a magnified view of a nozzle array and nozzles of a recording head.

FIG. 23 is a diagram that shows a magnified view of a nozzle array of a recording head.

In an example as shown in FIG. 32, the array of nozzles that discharge ink of the same color, which includes EVEN arrays and ODD arrays, is divided into two blocks at the center of the nozzle array: a downstream block (block 1) and an upstream block (block 2). The magnified portion as shown in FIG. 23 shows one part of the block 1 disposed at a downstream side in the sheet conveyance direction, and is provided with nozzle numbers, as shown in FIG. 23. Although not especially shown in FIG. 23, the block 2 at the upstream side in the sheet conveyance direction is provided with nozzle numbers in the same manner. That is, supposing that the sheet conveyance (that is, in this case, the sheet is conveyed in an amount equivalent to the command pulse value of 5,120) is optimally performed, a straight line printed by eighth nozzles of the block 1 and a straight line printed by eighth nozzles of the block 2 are formed at the same position.

Figure 8:
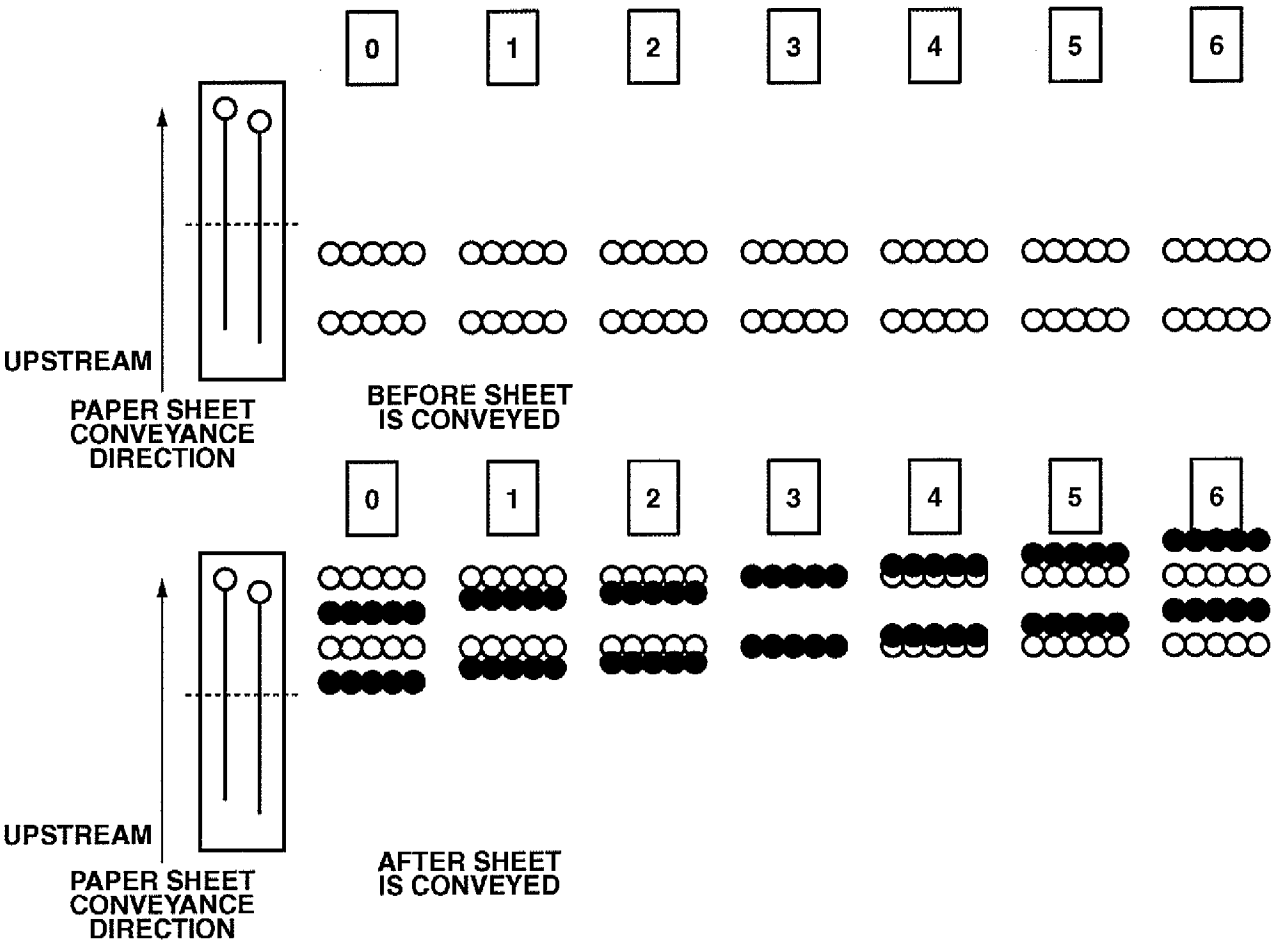
FIG. 8 is a schematic diagram of a printed patch.

FIG. 8 is a schematic diagram of the printed patch. In FIG. 11, plural patches are printed in each of the first and the second patch areas. However, with respect to the patch that is printed in each of the first and the second patch areas, the printing result is the same except for the print timing. Therefore, in FIG. 8, the patch that is printed in one area is shown only. As shown in FIG. 8, one patch area is constituted by seven patches. However, although an explanation is made here as to an example in which seven patches are used, the number of patches used in this case is not limited to seven.

In this regard, first, as shown in an upper portion of FIG. 8, the reference pattern is printed by using a predetermined nozzle positioned in the block 2 at an upstream side in the sheet conveyance direction.

The seven reference patterns are printed by using the same predetermined nozzle of the block 2. Next, the sheet is conveyed with the command pulse value of 5,120. Then, as shown in a lower portion of FIG. 8, for the seven adjustment patterns that are printed by using the nozzle in the block 1, the pattern is relatively shifted from the reference pattern, by printing the same with a combination of different nozzles.

Figure 24:
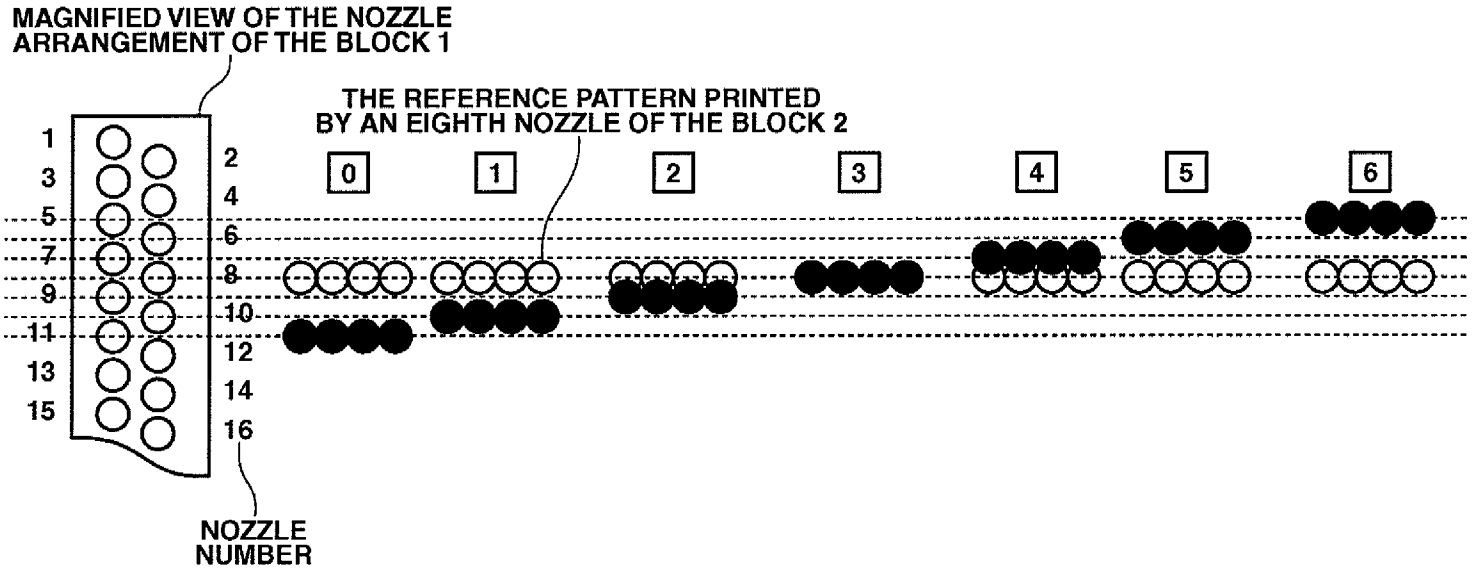
FIG. 24 is a diagram that shows a positional relationship between an arrangement of nozzles of the recording head and the adjustment patterns.

FIG. 24 is a schematic diagram showing the formation of the patch.

First, seven reference patches are printed by the eighth nozzle of the block 2. Then, the sheet is conveyed with the command pulse value of 5,120. Next, the relatively shifted patterns are formed by using the nozzle of the block 1.

Here, for explanation, the seven patches are provided with patch numbers from "0" through "6", serially (FIG. 8 and FIG. 24). In FIG. 8 and FIG. 24, the area factor of the patch number 3 is the lowest of the area factors if the command pulse value and the actual conveyance amount are the same, and accordingly, the conveyance amount of the recording medium when the patch with the lowest area factor is an ideal conveyance amount. Accordingly, an optimum sheet conveyance amount can be computed by selecting the patch with the lowest area factor. In printing the adjustment patterns, the area factor of the patch is changed by shifting the nozzle to be used for printing. In the example as shown in FIG. 24, with respect to the patches 0, 1, 5, and 6, the printed dots that are printed in the reference pattern and the adjustment pattern are not overlapped, and accordingly, the area factors are assumed to be the same. However, the area factors are not necessarily the same in actual printing. This is due to a change in the size of the placed droplet, depending on an amount of discharged liquid droplets and the type and kind of medium used in the actual printing. If the patch with the lowest area factor is selected based on a detection result of the optical type sensor, the selection becomes easier as the difference in the area factors of the patches becomes larger. Accordingly, as shown in FIG. 8, the pattern is not printed by using one single nozzle in printing the reference pattern and the adjustment pattern, but may be printed by using plural nozzles disposed with a predetermined distance between the same (for example, the distance equivalent to a length of six nozzles).

If the quantity of liquid droplets discharged from the nozzle is 4 pl, a dot diameter after being placed onto a recording medium whose smudge ratio is large is about 40 to 50 μm. Here, assuming that the predetermined distance is a distance equivalent to six nozzles, if the pattern is printed with respect to every six nozzles, the area factor of each of the patches 0 and 6 in FIG. 8 is about 100% and the area factor of the patch 3 is or below 50%, and thus a difference between the area factors becomes a maximum.

In this embodiment, for explanation, the reference pattern is printed by using the nozzle of the block 2 disposed at an upstream side, and the adjustment pattern is printed by using the nozzle of the block 1 at a downstream side. However, if either of the patterns is printed by using the nozzle of the block 1 or the nozzle of the block 2, there occurs no difference.

Figure 10:
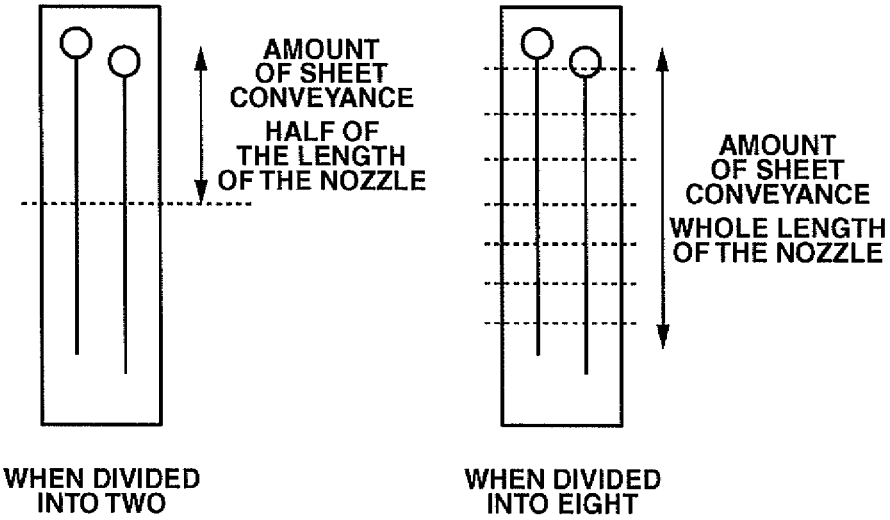
FIG. 10 is a diagram that explains a case where a number of divisions of a nozzle array is changed.

In addition, the adjustment resolution can be increased by increasing a number of division (number of blocks) of the nozzle array for printing the patch. That is, the adjustment resolution can be made higher by dividing the nozzle array into multiple blocks, printing the reference pattern by using the furthest upstream nozzle, and by printing the adjustment pattern by using the furthest downstream nozzle. For an example of the case where the nozzle array is divided into multiple blocks, an explanation is made as to a case where the nozzle array is divided into eight. FIG. 10 shows a state where the nozzle array is divided into two blocks and a state where the nozzle array is divided into eight blocks in printing the patch.

If the nozzle array is divided into two blocks, the sheet conveyance amount until the reference pattern and the adjustment pattern are overlapped is equivalent to a length half of the nozzle length. On the other hand, if the nozzle array is divided into eight blocks, when the reference pattern and the adjustment pattern are printed by using the furthest upstream block and the furthest downstream block, the sheet conveyance amount is substantially equivalent to the nozzle length.

That is, with respect to the command pulse value, the command pulse value until the patches are overlapped is 5,120, in the case of division into two blocks. On the other hand, the command pulse value for overlapping the pattern printed by using the furthest upstream block and the pattern printed by using the furthest downstream block can be computed by an equation 1,280×7=8,960 (here, an ideal command pulse value in the case where the sheet is conveyed for a length equivalent to one-eighth of the nozzle length is computed as 160×25.4/1,200/25.4×9,600=1,280). This means that the adjustment accuracy that can be determined in relation to a pattern in the case of eight-block division of the nozzle array, in a case where the shift of the sheet conveyance amount per every sheet is constant, is about two times larger than the shift occurring in the case of the two-block division.

For example, if the actual sheet conveyance amount differs in an amount equivalent to 1 pulse for every command pulse value of 1,280, if the patch is printed by dividing the nozzle array into two blocks, with respect to the reference pattern and the adjustment pattern, the conveyance amount of the recording medium is shifted by an amount equivalent to the command pulse value for four pulses. In this case, with respect to each of the EVEN array and the ODD array, the distance between the adjacent nozzles is 1,200 dpi, and thus the distance between the predetermined nozzle in the EVEN array and the nozzle in the ODD array adjacent to the corresponding nozzle in the EVEN array is 2,400 dpi. Thus, the command pulse value when the recording medium is shifted in the direction of conveyance by an amount equivalent to a length of one nozzle is 4 (1×25.4/1200/25.4×9600=4). Therefore, if the patch is printed by dividing the nozzle array into two blocks in the case where the actual conveyance amount differs by an amount equivalent to one pulse per every command pulse value of 1,280, the reference pattern and the adjustment pattern are mutually shifted by an amount equivalent to one dot in the case of the command pulse value of 5,120. In this case, the patch with the lowest area factor when the reference pattern and the adjustment pattern are overlapped is the patch 2, not the patch 3.

On the other hand, if the patch is printed by dividing the nozzle array into eight blocks, with respect to the reference pattern and the adjustment pattern, the conveyance amount of the recording medium is shifted by an amount equivalent to seven pulses of command pulse value. That is, the reference pattern and the adjustment pattern are mutually shifted by an amount equivalent to two dots. Therefore, the patch with the lowest area factor when the reference pattern and the adjustment pattern are overlapped is the patch 1, not the patch 3.

As described above, if the actual conveyance amount in the case of the predetermined command pulse value is shifted in the same amount, the change in the patch is large when the nozzle array is divided into multiple blocks to increase the amount of conveyance performed with respect to the reference pattern and the adjustment pattern. Further, if the change in the patch is large, a very small amount of shift can be determined with high accuracy. The reason is explained below.

The computation of the conveyance amount depends on the resolution of a nozzle pitch. In the patch 3 and the patch 4 as shown in FIG. 24, the amount of shift that can be discriminated is about 20 μm (1,200 dpi).

Now, an explanation is made as to a case where the nozzle array is divided into eight blocks and the patch is formed by using a nozzle of the furthest upstream block and a nozzle of the furthest downstream block. In this regard, the conveyance amount equivalent to one pulse is about 3 μm (25.4/1200/7). In the case of two-block division of the nozzle array, the conveyance amount equivalent to one pulse is about 20 μm (25.4/1200/1). The conveyance amount is about 2.6 μm for one pulse, and accordingly, in the case of the eight-block division, when there is a variance in an amount equivalent to one pulse, the variance in an amount equivalent to about one patch is determined. On the other hand, in the case of two-block division, the pattern does not substantially change even when there is a variance for one pulse. Thus, a very small amount of conveyance can be determined with high accuracy if the change in the patch is large. By using this method, the amount of adjustment of sheet conveyance can be determined with high accuracy with a resolution higher than the resolution of the nozzle arrangement.

The conveyance variance occurring when the conveyance roller is rotated by a very small angle cannot be determined unless a high-performance determination device is used. However, the conveyance variance is accumulated when the conveyance roller is rotated by a large amount, and thus the conveyance variance can be determined without using a very high-performance determination device. That is, if the performances of the determination devices are the same, the conveyance variance occurring in the case where the conveyance roller is rotated by a very small angle cannot be determined, but the conveyance variance that occurs when the conveyance roller is rotated in a large amount can be determined.

The method of computing the sheet conveyance amount based on the reference pattern and the adjustment pattern is as described above.

Next, a detailed explanation is made as to a method of printing the patch for obtaining the amount of conveyance variance according to this embodiment in the case of a very small phase angle of the conveyance roller.

Figure 12:
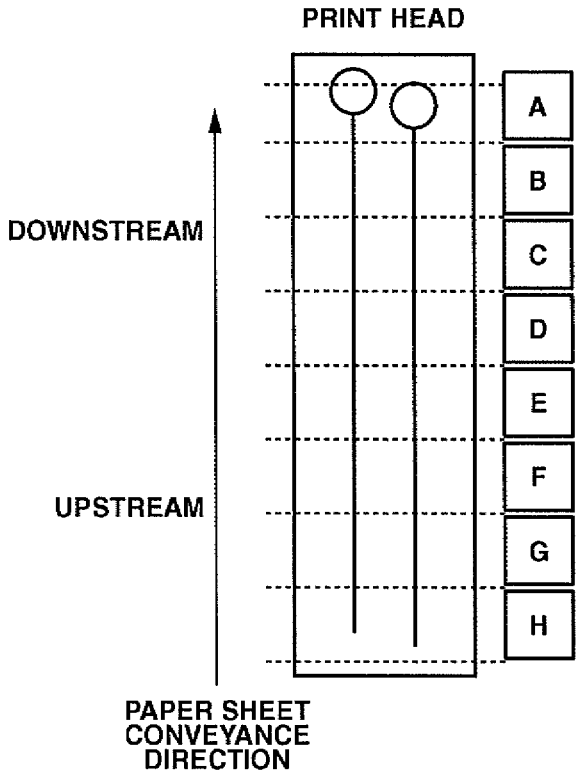
FIG. 12 is a schematic diagram showing a case where the nozzle array is divided into eight.
Figure 13:
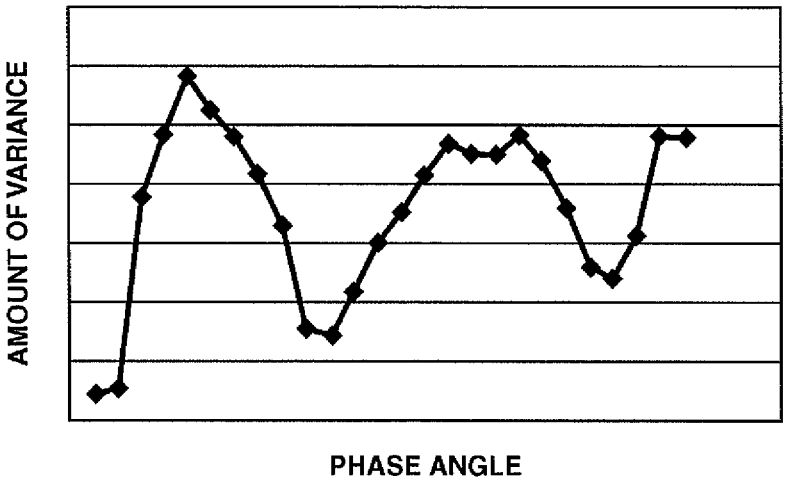
FIG. 13 is a diagram showing an example of measurement of the variance in the roller conveyance.

FIG. 12 is a schematic diagram of a case where the nozzle array is divided into eight blocks. For the adjustment value of the conveyance variance, the adjustment amount may be obtained per one pass of conveyance in conveying the sheet. That is, the patch may be formed by using nozzle blocks A and B as shown in FIG. 12 by using the method of adjusting the sheet conveyance. This shows that if the circumference of the roller is 47 mm, a sheet variance amount of about 3.4 mm (that is, one-fourteenth rotation of the roller) is measured. If the measurement is repeated for the whole circumference of the roller, the measured value to be obtained is as shown in FIG. 13. In FIG. 13, a vertical axis indicates the variance in the conveyance amount, and the horizontal axis indicates the position of the conveyance roller. FIG. 13 shows a variance of conveyance amount for 2.5 rotations of the conveyance roller. FIG. 13 shows that the conveyance amount varies with a period of one rotation of the conveyance roller.

However, in obtaining the adjustment amount of conveyance variance based on two adjacent points such as the portion between the points A and B, the S/N ratio is low and an accurate adjustment amount cannot easily be obtained due to a slide of the sheet and an affect from an accuracy in the conveyance by the roller. A noise component in relation to the slide in the sheet and the affect from an accuracy in the conveyance by the roller corresponds to random noise. Therefore, by accumulating the adjustment amount at the same position in one period, the S/N ratio can be improved. In order to measure a stable conveyance variance, an adjustment value for several rotations of the roller is necessary. However, for example, in a case where the patches are printed for ten rotations of the roller for ten times accumulations, a large amount of recording medium and ink are necessary.

In this regard, in order to improve the S/N ratio, the conveyance variance is computed based on the difference between two patches.

The difference between two patches printed in the first and the second patch areas is equivalent to the measured value between two adjacent points with a high S/N ratio, and thus the measurement of conveyance variance in the area with a small-amount printing is available.

Hereinbelow, an explanation is made as to a method of computing the measured value between the two adjacent points with a high S/N ratio based on two patches, with reference to FIG. 14.

The division into blocks of the nozzle array is the same as an example as shown in FIG. 12. In FIG. 14, the roller position number represents the position of the roller and the contacting position of the media onto which printing is performed. That is, assuming that printing is performed with the nozzle block D, in an initial state, the printing is performed to the roller position number 5 (the medium and the roller position number are the same). When the medium is conveyed for an amount equivalent to one band, the area into which the printing is performed by the nozzle block D is the roller position number 4 (the medium and the roller position number are the same).

Figure 14:
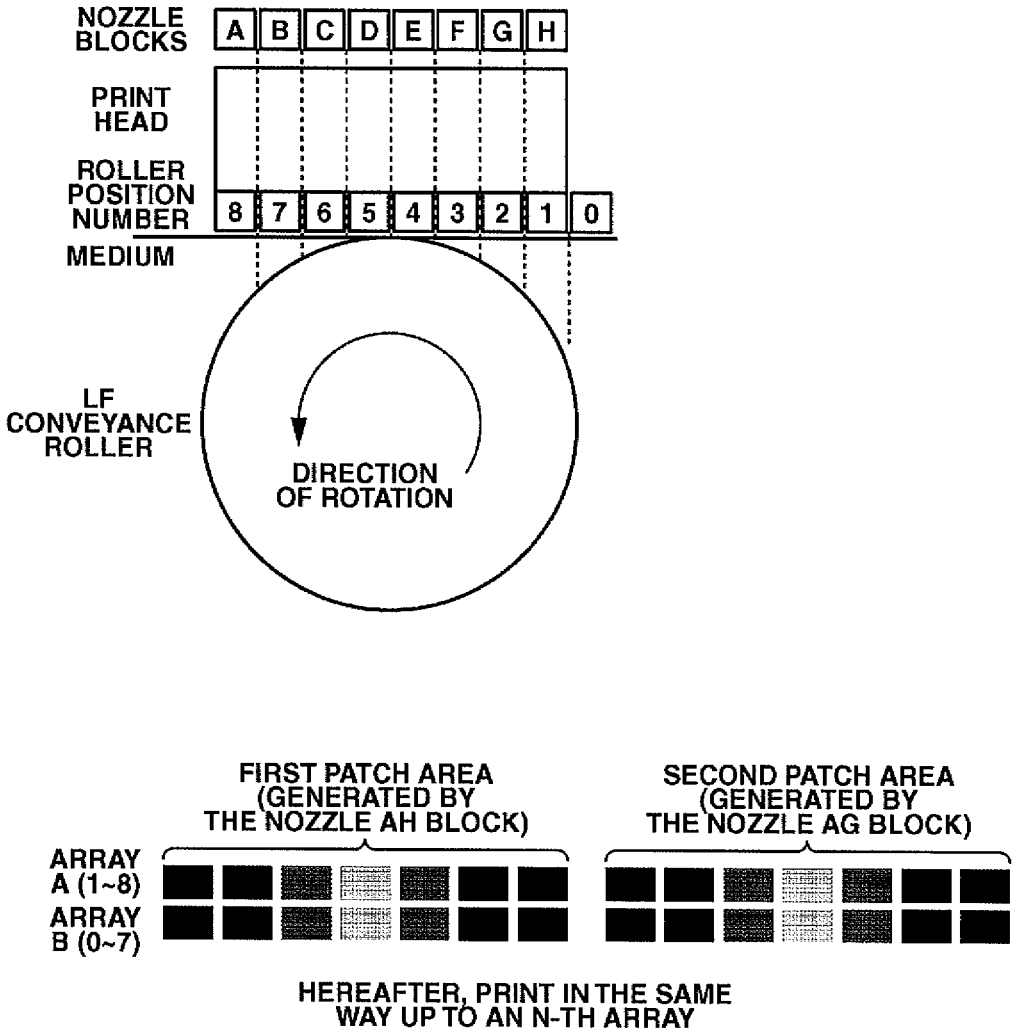
FIG. 14 is a schematic diagram that shows a relationship between a nozzle block, a position of the conveyance roller, and a patch.

In FIG. 14, a first patch is a pattern formed by an AH nozzle block, and a second patch is a pattern formed by an AG nozzle block. The amount computed for a portion between the adjacent two points computed by the two patches is equivalent to the conveyance amount between the GH nozzle block.

Figure 15:
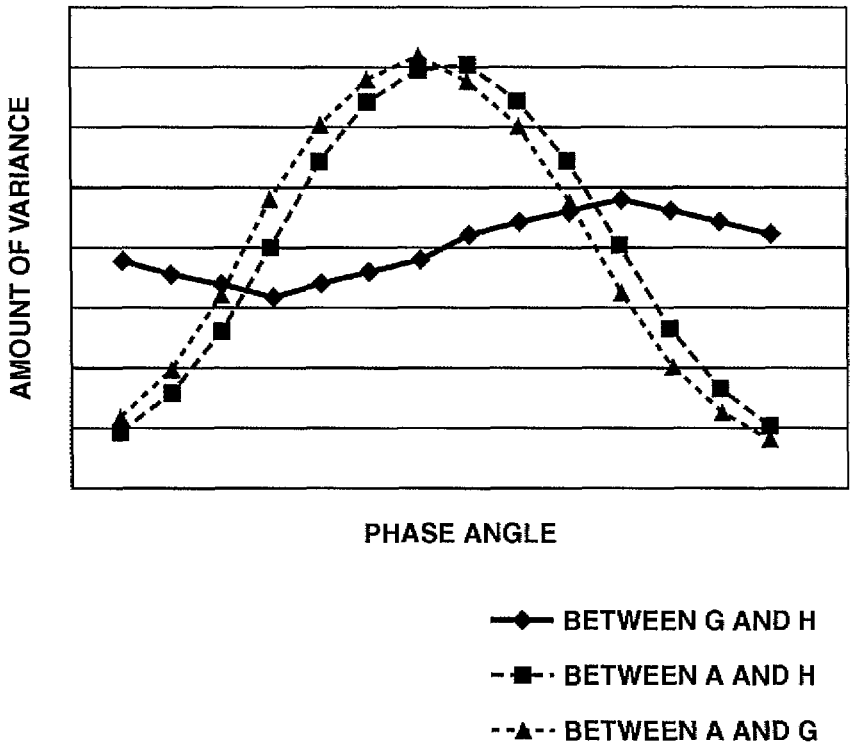
FIG. 15 is a diagram that shows a relationship between a predetermined phase angle of the roller and the conveyance variance.

The measured data between the AH portion, AG portion, and GH portion is as shown in FIG. 15. The measured value obtained by the difference between AH portion and AG portion is the same as the measured value obtained with respect to the GH portion.

Accordingly, the random noise component superposed in the AB portion is the same as that of a case where seven times averaging for the AH portion, and six times averaging for the AG portion. Thus, by computing the conveyance amount of the GH portion by using the difference between the AH portion and the AG portion, the measured value between two adjacent points with a high S/N ratio can be computed.

FIGS. 16 through 16D respectively show a method of forming the two patches.

First, for an easier understanding, a method of computing the measured value between the two adjacent points with respect to one single point of the roller is explained.

First, by using an H nozzle block positioned upstream in the sheet conveyance direction, a first pattern (reference pattern) is printed in a first patch area. Here, because the operation is performed for a first pass of printing, the operation thereof is referred to as a first pass operation. Next, the sheet is conveyed by a conveyance amount equivalent to one block, and then by using a G nozzle block, a first pattern (reference pattern) is printed in a second patch area. The operation is equivalent to a second pass of printing, and thus the operation is referred to as a second pass operation. In the same way, for the third through the eighth pass, each operation corresponding thereto for performing sheet conveyance and recording scanning is referred to as an X-th pass operation. For the third through seventh passes, the print operation is not performed and only the sheet conveyance is performed. For the eighth pass operation, a second pattern (adjustment pattern) is printed by using an A nozzle block in both the first and the second patch areas. In the first patch area, the conveyance amount of the recording medium when the conveyance roller is rotated from the roller position number 1 to the roller position number 8 as shown in FIG. 14 can be computed. In the second patch area, the conveyance amount of the recording medium when the conveyance roller is rotated from the roller position number 2 to the roller position number 8 as shown in FIG. 14 can be computed. By determining the difference, the conveyance amount for the roller position number 1 to the roller position number 2 is computed. That is, by using this method, the conveyance variance that depends on the sheet conveyance with a high S/N ratio can be computed, without increasing the amount of consumption of medium in the sheet conveyance direction.

As described above, a method of computing the measured value between the two adjacent points at one single point of the roller is explained. In actuality, the adjustment value for one full rotation of the roller is consecutively computed.

Examples of the manner thereof in this case are shown in FIG. 17A through 17D. For a first pass, the reference pattern is printed in the first patch area by using the H nozzle block. Then, for a second pass, the reference pattern is printed in the second patch area by using the G nozzle block, and the reference pattern is printed in the first patch printing area by using the H nozzle block. In this case, the printed patterns are not overlapped because the sheet is conveyed in the manner as shown in each of FIG. 17A through 17D. In the same way, hereafter, the reference pattern is printed by using the G nozzle block and the H nozzle block until the seventh pass. For the eighth pass, the adjustment pattern is printed by using the A nozzle block, and the reference pattern is printed by using the G nozzle block and the H nozzle block. Although not shown in FIG. 17A through FIG. 17D, for a ninth pass and beyond, the adjustment pattern is printed by using the A nozzle block, and the reference pattern is printed by using the G nozzle block and the H nozzle block.

The conveyance amount at the predetermined position of the conveyance roller can be obtained based on the patch that is printed in the first and the second patch areas in each pass in this way. As shown in FIG. 14, the conveyance amount in relation to the roller positions 1 through 8 can be computed by using the A array of the first patch, and the conveyance amount in relation to the roller positions 0 through 7 can be computed by using the B array of the first patch. In the same way, the conveyance amount in relation to the roller positions 2 through 8 can be computed by the A array of the second patch, and the conveyance amount in relation to the roller positions 1 through 7 can be computed by the B array of the second patch.

In this way, the conveyance amount in relation to the roller positions 1 and 2 can be obtained by the first and the second patch of the A array. In the same way, the conveyance amount in relation to the roller positions 0 to 1 can be obtained by the first and the second patch of the B array. By consecutively performing this for one full rotation of the conveyance roller, the amount of conveyance variance in the case of the very small phase angle at the predetermined position of the conveyance roller can be obtained. Note that the degree of eccentricity of the conveyance roller can be obtained based on the amount of conveyance variance per each very-small phase angle of the conveyance roller.

Figure 18:
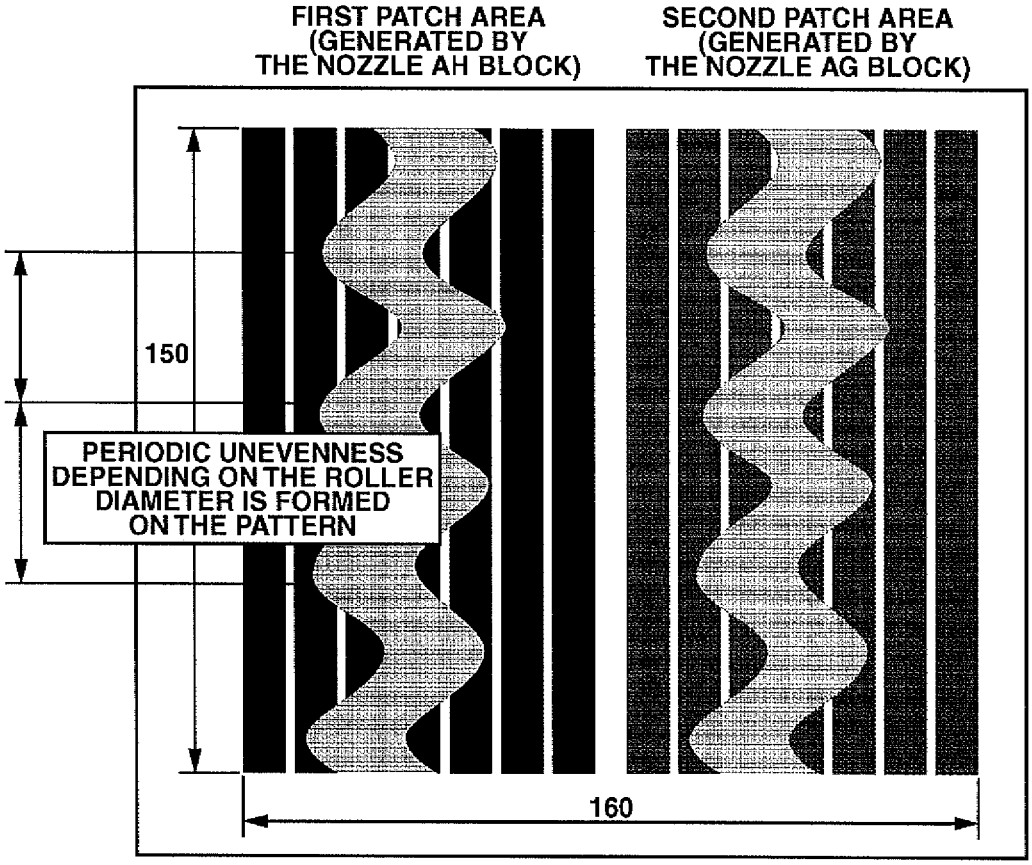
FIG. 18 is a diagram showing a whole image of the printed adjustment pattern according to this embodiment.

FIG. 18 shows a whole portion of the patch. In a first patch, the conveyance amount between the first pass and the eighth pass can be obtained, and in the second patch, the conveyance amount between the second pass and the eighth pass can be obtained.

As described above, the method of actually printing the patch is explained.

The conveyance in the LF direction is not necessarily the same in relation to the direction of sheet conveyance and the direction of sheet return. Therefore, the print operation of the patch according to this embodiment needs to be performed during the sheet conveyance for one specific direction only.

In order to perform the determination of the conveyance variance in the simplest way, a method may be such that after the patch is printed, the sheet is drawn back, and then the determination is performed. However, the adjustment and the determination are carried out in different operations, resulting in too much time. In addition, the printed surface of the recording medium is drawn back to the inside of the apparatus body, and thus the apparatus body is likely to be smeared by the ink droplet.

Figure 19:
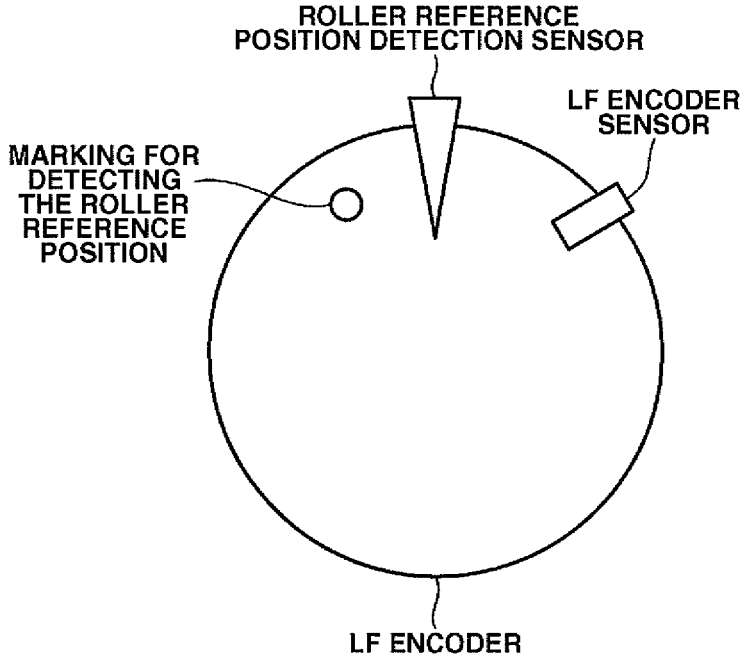
FIG. 19 is a schematic diagram showing a detection of a reference position of the conveyance roller.

In order to overcome this drawback, as shown in FIG. 19, the optical type sensor may be disposed. When the optical type sensor is disposed as shown in FIG. 19, the patch can be printed by the forward-direction scanning of the carriage and the determination can be performed by the returning scanning by which the carriage is returned. By using this method, the conveyance variance can be determined in a time substantially the same as the length of time taken for printing the patch, without smearing the apparatus body.

Figure 20:
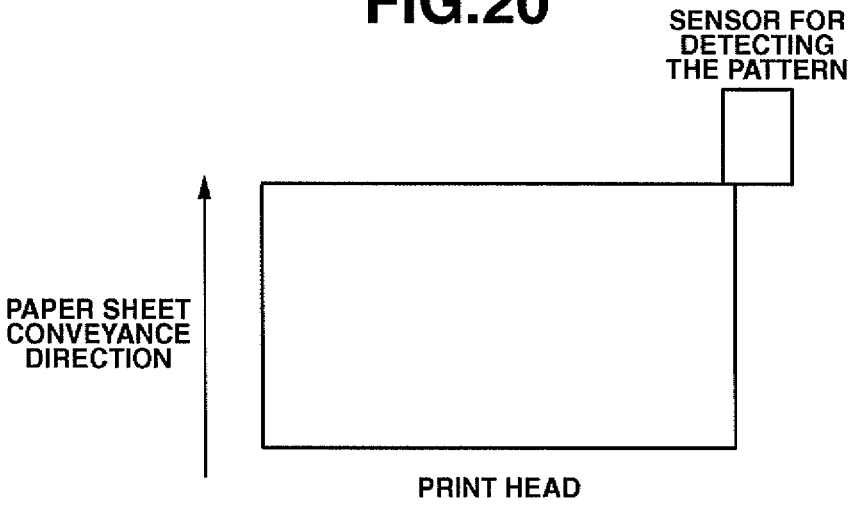
FIG. 20 is a schematic diagram that shows an attaching position of a sensor for detecting the pattern.

In addition, in order to obtain and reflect the conveyance variance, it is necessary to provide a reference position with respect to the LF conveyance roller. In this regard, a sensor for determining a reference position of the LF conveyance roller may be used separately from and in addition to an encoder sensor that controls the conveyance in the LF direction. FIG. 20 is a schematic diagram of the reference position. The conveyance variance can be corrected by locating an absolute position that reflects an absolute position at which the conveyance variance at the same position.

Next, the computation of the adjustment value is explained.

Figure 9:
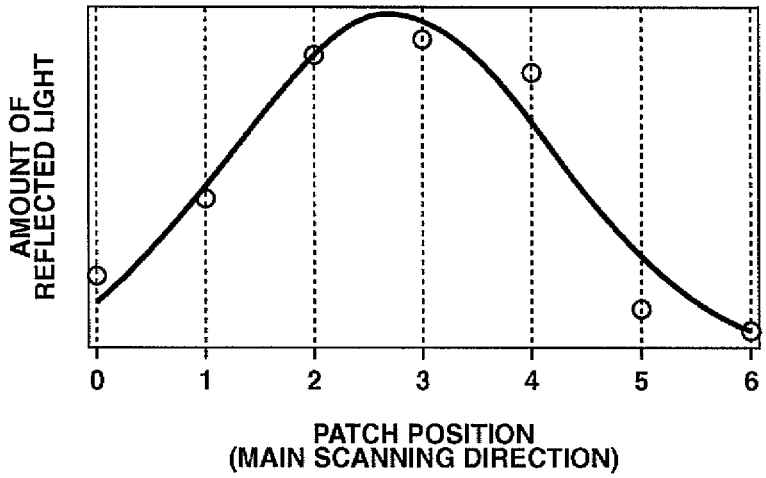
FIG. 9 is a diagram showing an example of a result of detection of the adjustment patterns by the reflective optical sensor.

If the density of seven first patches in the A array among the patches as shown in FIG. 14 is determined by using the reflection type optical sensor 30, a result of detection as shown in FIG. 9 is obtained. Based on the seven values, a position at which the density becomes a maximum is computed by functional approximation, and thus the conveyance amount when the determination value obtained by the determination by the reflection type optical sensor 30 becomes a maximum is computed. Note that in this case, the conveyance amount when the patch at the time the determined value determined by the reflection type optical sensor 30 becomes a maximum may be defined as the conveyance amount in the AH portion.

As described above, by performing the method of computing the conveyance amount in the AH portion based on the density of the patch of one array with respect to plural arrays, the value of the conveyance amount for the plural arrays of the first patch can be obtained. The value corresponding to the number of arrays of the first patch is equivalent to the conveyance amount for the AH portion (see FIG. 14) at each phase angle of the conveyance roller. In the same way, the value for the number of the arrays can be obtained from the second patch. The value corresponding to the number of arrays of the second patch thus obtained is equivalent to the conveyance amount for the AG portion at each phase angle of the conveyance roller. Thus, the value of the A array between adjacent two points (GH portion as shown in FIG. 14) from the difference in the A array of the first patch and the A array of the second patch. In this case, the value for the GH portion as shown in FIG. 14 corresponds to the conveyance amount for the portion between the roller positions 1 and 2. By determining the difference between the first patch and the second patch with respect to all the arrays, the value for the number of arrays between the adjacent two points can be computed. Here, the computed value has a waveform having a period as shown in FIG. 15.

The variance as shown in FIG. 15 is a variance under an ideal state. In actuality, the variance per phase is superposed with the noise.

That is, the sheet conveyance amount computed per phase angle of the conveyance roller can be represented by [AB+N1, BC+N2, CD+N3, DE+N4, EF+N5, FG+N6], and [GH+N7] (where N1 through N7 are the random noise components).

Here, in this case, the measurement between adjacent two points is difficult because the random noise components are large in relation to the variance per phase angle. However, with respect to the measured value for the AH portion, N1 through N7 are random noise components, so that the components are averaged, and on the other hand, the variance per phase angle is accumulated. As a result, the S/N ratio can be improved. The result to be obtained is AH+N17 (where N17 is an average of N1 through N7).

The same applies to the AG portion. The result to be obtained is AG+N16' (where N16' is an average of the random noise components in the second patch area. The random noise components include the variance occurring due to the placement of the dots for the patch, in addition to the variance in the sheet conveyance amount, and therefore, N16' is different from N1 through N7).

As a result, by determining the difference between the two portions, the adjustment amount is between the two adjacent points (GH) with a high S/N ratio, with a smaller random noise component.

In order to further improve the measurement accuracy, the conveyance variance may be modeled in computing the adjustment value.

The conveyance variance depends on the roller, and therefore has a period in accordance with the period of the roller. In this regard, the functional approximation is performed based on the model, and the obtained value is reflected to the sheet conveyance.

The causes of the conveyance variance include the variance in the outer shape of the roller, the deflection of the roller, and the attachment of the roller supporting member. In the case of dot diameter of 4 pl of the liquid droplet that is used in this embodiment, it is known that the print unevenness occurring due to the conveyance variance affects the quality of the printed image, if the amplitude of the conveyance variance is larger than 30 μm. It can be implemented to suppress the component of the conveyance variance occurring due to the variance in the roller outer shape and the deflection of the roller to be less than or equal to 30 μm, by improving the machine accuracy.

However, the attachment of the roller supporting member cannot be controlled. On the other hand, the conveyance variance component is often determined by the attachment of the roller supporting member. In this regard, by focusing on the attachment of the roller supporting member, the modeling of the conveyance variance is effected.

Figure 21:
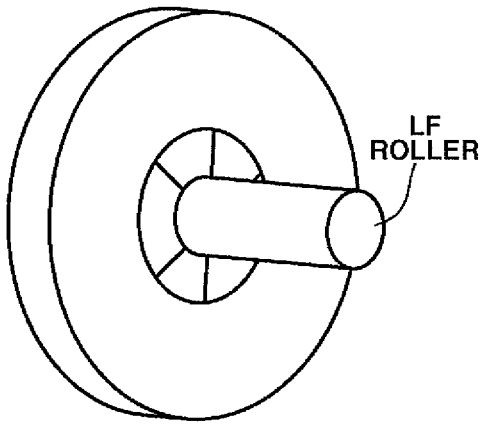
FIG. 21 is a schematic diagram of the conveyance roller attachment member.
Figure 22:
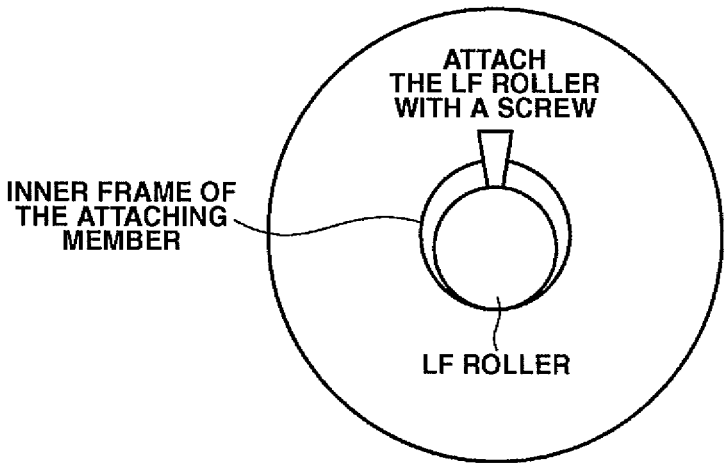
FIG. 22 is a diagram that shows a positional relationship between the conveyance roller and the attachment member.

FIG. 21 is a diagram showing the roller supporting member used in the present invention. If the central axis of the roller and the central axis of the supporting member are matched with each other, the conveyance variance does not occur. However, depending on the tightness of the attachment screw, the axis is mutually shifted, and the conveyance variance occurs due to the affect from the axis shift (FIG. 22).

Incidentally, the conveyance variance occurring due to the attachment of the roller supporting member affects in the same degree in a positive (+) direction and a negative (−) direction. That is, the conveyance variance within one period is shaped that can be substantially modeled by a sign function. In this regard, by performing a sign function approximation to a result of measurement as shown in FIG. 13, the conveyance variance can be obtained with a higher S/N ratio.

As described above, the adjustment value computation is explained.

The conveyance variance depends on the body of the apparatus, and therefore, adjustment needs to occur at the time of shipment from the factory. In addition, the adjustment needs to be performed when an LF driving unit including the LF roller, the LF encoder, and the like is exchanged. Note that in considering the aged deterioration, the user may perform the adjustment. In this case, when the user performs the setting for obtaining the conveyance variance through a utility setting screen of a printer driver, the operation for obtaining the conveyance variance may be performed by the recording apparatus.

As described above, the method for computing the conveyance variance from the difference in the density of the two patches is explained.

Here, as a repeated explanation, the present invention is constituted as described below.

In order to obtain a very small conveyance variance per phase angle of the conveyance roller, it is essential to alleviate the random noise by averaging processing. However, the inventor of the present invention found that the random noise can be decreased during the averaging processing at different phase angles without performing plural determinations at a desired phase angle. That is, the difference between the conveyance variance that is accumulated for N times occurring due to N times of sheet conveyance and the conveyance variance that is accumulated for (N−1) times occurring due to (N−1) times of sheet conveyance represents the sheet conveyance variance for a last N-th time conveyance with a high accuracy. According to this method, the last N-th sheet conveyance variance can be represented in a state in which the random noise is decreased. The present invention, devised based on this knowledge, provides that the consumption amount of sheets used for determination can be suppressed to a minimum. Note that there may be a method in which the sheet is returned and the test printing is performed again in the same area. However, the change in the state of loads occurring due to the returning of the sheet brings about another variance factor against the aspect of the present invention such that the conveyance variance in the case of the normal printing is accurately determined, and thus such method cannot be employed.

Further, with respect to the method in which the accumulated value for (N−1) times operations is subtracted from the accumulated value for the N times operations, there is a meritorious effect such that it is possible to remarkably determine the change in the density of the patch by performing the accumulation even in the case where the variance of the desired phase angle is very small. That is, by accumulating the very small variance for more than (N−1) times, the accumulative variance is shifted close to one-dot shift (21 micron in 1,200 dpi), or to exceed the one-dot shift, and thus the change in the density occurring due to the interference between the reference pattern and the adjustment pattern can be remarkably determined. Assuming that the conveyance amount of the N-th time can be determined without being affected by the noise, the change in the density is very small, and thus it is difficult to compute the conveyance amount from the reference patch formed due to the interference between the reference pattern and the adjustment pattern (each having the patch positioned by being shifted by one dot in the sheet conveyance direction). On the other hand, if the change in the density becomes large because of the accumulation, it is easy to compute the conveyance amount from the reference pattern, and thus the accuracy improves as a result of computing the conveyance amount for the N-th time from the difference.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A recording apparatus that performs recording on a recording medium using a recording head comprising:

a conveyance roller configured to perform a conveyance of a recording medium between one recording by the recording head and a next recording by the recording head;

a controlling unit controlling the recording head to record a first pattern for detecting a first conveyance amount in the conveyance of N times, N being an integral number equaling to or more than 2, from a state that the conveyance roller is in contact with the recording medium at a predetermined position of the conveyance roller, and a second pattern for detecting a second conveyance amount in the conveyance of N−1 times from a state that one conveyance has been performed from the state that conveyance roller is in contact with the recording medium at the predetermined position;

a detecting unit configured to detect the first conveyance amount from the first pattern and the second conveyance amount from the second pattern; and a correcting unit configured to correct a conveyance amount from the state that the conveyance roller is in contact with the recording medium at the predetermined position of the conveyance roller to the state that one conveyance is performed, based on the first amount and the second amount.

2. A recording apparatus according to claim 1, further comprising a measuring unit configured to measure optical characteristics of each of the first and the second pattern.

3. The recording apparatus according to claim 1, wherein a position where the roller is in contact with the recording medium varies at each rotation of the roller with the conveyance.

4. A method of correcting a conveyance amount in a recording apparatus that performs recording on recording medium by using a recording head and a conveyance roller for performing a conveyance of the recording medium between one recording by the recording head and a next recording by the recording head, the method comprising:

controlling the recording head to record a first pattern for detecting a first conveyance amount in the conveyance of N times, N being an integral number equaling to or more than 2, from a state that the conveyance roller is in contact with the recording medium at a predetermined position of the conveyance roller, and a second pattern for detecting a second conveyance amount in the conveyance of N−1 times from a state that one conveyance has been performed from the state that conveyance roller is in contact with the recording medium at the predetermined position;

detecting the first conveyance amount from the first pattern and the second conveyance amount from the second pattern; and correcting a conveyance amount from the state that the conveyance roller is in contact with the recording medium at the predetermined position of the conveyance roller to the state that one conveyance operation is performed, based on the first conveyance amount and the second conveyance amount.

5. The method according to claim 4, wherein a position where the roller is in contact with the recording medium varies at each rotation of the roller with the conveyance.

* * * * *